US011492792B2

(12) United States Patent
Burton et al.

(10) Patent No.: US 11,492,792 B2
(45) Date of Patent: Nov. 8, 2022

(54) MODULAR TOILET SYSTEMS AND METHODS

(71) Applicant: Wish for WASH, LLC, Dunwoody, GA (US)

(72) Inventors: Jasmine Kaila Burton, Atlanta, GA (US); Mariel Rezende, Potomac, MD (US); Brandon Dean Philbrick, Atlanta, GA (US)

(73) Assignee: Wish for Wash, LLC, Atlanta, GA (US)

( * ) Notice: Subject to any disclaimer, the term of this patent is extended or adjusted under 35 U.S.C. 154(b) by 0 days.

(21) Appl. No.: 17/163,807

(22) Filed: Feb. 1, 2021

(65) Prior Publication Data

US 2021/0238837 A1 Aug. 5, 2021

Related U.S. Application Data

(60) Provisional application No. 62/969,314, filed on Feb. 3, 2020.

(51) Int. Cl.
*E03D 11/13* (2006.01)
*E03D 11/16* (2006.01)

(52) U.S. Cl.
CPC ..... *E03D 11/13* (2013.01); *E03D 11/16* (2013.01); *E03D 2201/40* (2013.01)

(58) Field of Classification Search
CPC ..... A47K 11/02; A47K 13/105; E03D 11/04; E03D 11/16; E03D 2201/40
See application file for complete search history.

(56) References Cited

U.S. PATENT DOCUMENTS 3,594,831 A * 7/1971 Brewer ..... A47K 13/005 4/237
3,840,907 A 10/1974 Sundberg
(Continued)

FOREIGN PATENT DOCUMENTS

CA 1054307 A 5/1979
CN 2156224 Y 2/1994
(Continued)

OTHER PUBLICATIONS

Meet Jasmine Burton of Wish for Wash, http://voyageatl.com/interview/meet-jasmine-burton-wish-wash-atlanta/?fbclid=IwAR1jjlPp1EbOfnK4XwvCUQeEBmQgqG9ij6qZiYuO4z1wdJTWINhlZ2NXQwE, VoyageATL, Nov. 28, 2018.
(Continued)

*Primary Examiner* — Janie M Loeppke
(74) *Attorney, Agent, or Firm* — Womble Bond Dickinson (US) LLP

(57) ABSTRACT

A toilet system comprising a toilet seat that is configured for a user to sit on or squat over for depositing of human waste. The toilet seat can include a toilet seat body with a toilet seat opening. A riser can be configured to support and elevate the toilet seat to a selected or prescribed height and can include a riser body with a riser opening and a first riser attachment portion being connectable to one or more seat attachment portions of the toilet seat. A base can include a base body that has a base opening and a base attachment portion that is connectable to a second riser attachment portion of the riser and/or the one or more seat attachment portions of the toilet seat. A plurality of inserts can be configured to be at least partially received within the riser opening and/or the base opening to allow for reconfiguration of the toilet system.

14 Claims, 16 Drawing Sheets

(56) References Cited

U.S. PATENT DOCUMENTS

| | | | | |
|---|---|---|---|---|
| 4,012,797 | A | 3/1977 | Kristoffersen | |
| 4,054,958 | A | 10/1977 | Widham | |
| 4,196,082 | A | 4/1980 | Salokangas et al. | |
| 4,213,864 | A | 7/1980 | Asikainen | |
| 4,233,696 | A | 11/1980 | Ibel | |
| 4,477,934 | A | 10/1984 | Salminen | |
| 4,627,116 | A | 12/1986 | Shimizu | |
| 4,653,128 | A | 3/1987 | Canalizo | |
| 4,710,989 | A | 12/1987 | Grenthe | |
| 5,171,690 | A | 12/1992 | Ylosjoki | |
| 5,303,431 | A | 4/1994 | Johansson | |
| 5,742,956 | A | 4/1998 | Tarver | |
| 5,765,236 | A * | 6/1998 | Bethanis | A47K 13/00 4/237 |
| D435,092 | S * | 12/2000 | Higgs | D23/311 |
| 6,212,698 | B1 * | 4/2001 | Stingley | A61B 10/007 4/315 |
| 6,948,195 | B2 | 9/2005 | Culmer | |
| 7,380,292 | B1 | 6/2008 | Harris | |
| 7,543,339 | B1 | 6/2009 | Harris | |
| D694,869 | S | 12/2013 | Ishiyama | |
| 9,247,852 | B2 * | 2/2016 | Trott | A47K 11/02 |
| 9,587,388 | B2 * | 3/2017 | Ding | E03D 5/01 |
| 2002/0177111 | A1 | 11/2002 | Underhill et al. | |
| 2008/0256696 | A1 * | 10/2008 | Walsmley | A61B 10/0038 4/420 |
| 2013/0053729 | A1 | 2/2013 | Stevie-Wages et al. | |
| 2014/0230137 | A1 | 8/2014 | Gatarz et al. | |
| 2015/0245748 | A1 | 9/2015 | Banner et al. | |

FOREIGN PATENT DOCUMENTS

| | | | |
|---|---|---|---|
| CN | 2526370 | Y | 12/2002 |
| CN | 1105542 | C | 4/2003 |
| CN | 2729175 | Y | 9/2005 |
| CN | 2746018 | Y | 12/2005 |
| CN | 201009891 | Y | 1/2008 |
| CN | 202298850 | U | 7/2012 |
| CN | 202831150 | U | 3/2013 |
| CN | 103114633 | A | 5/2013 |
| CN | 202935357 | U | 5/2013 |
| CN | 102337757 | B | 7/2013 |
| CN | 203834621 | U | 9/2014 |
| CN | 204112453 | U | 1/2015 |
| CN | 204467942 | U | 7/2015 |
| CN | 204475466 | U | 7/2015 |
| CN | 104088347 | B | 12/2015 |
| CN | 105123536 | B | 12/2015 |
| CN | 104207714 | B | 4/2016 |
| CN | 103976678 | B | 5/2016 |
| CN | 205296333 | U | 6/2016 |
| CN | 205411060 | U | 8/2016 |
| CN | 106175549 | A | 12/2016 |
| CN | 105339566 | B | 5/2017 |
| DE | 27 54 620 | A1 | 6/1979 |
| DE | 102 15 133 | A1 | 10/2002 |
| EP | 0 500 903 | B1 | 9/1992 |
| EP | 1 099 804 | A1 | 5/2001 |
| ES | 2 664 242 | T3 | 4/2018 |
| JP | 2010-527672 | A | 8/2010 |
| KR | 10-0595742 | B1 | 12/2005 |
| KR | 20-0475099 | Y1 | 11/2014 |
| SE | 0002622 | L | 1/2001 |
| WO | WO 2014/130017 | A1 | 8/2014 |
| WO | WO 2018/082514 | A1 | 5/2018 |
| WO | WO 2018/225082 | A1 | 12/2018 |

OTHER PUBLICATIONS

Nikki Kallio, Rotary Scholar Helps Create Innovative Toilet, https://www.rotary.org/en/rotary-scholar-helps-create-innovative-toilet?fbclid=lwAR0JQr_ejtIWZCBzRVtca1FrLC-b5ZKi9KCLT5bzywb0gloUUaXItvPWoL8, The Rotarian, downloaded Jun. 24, 2021.

Chat w/Jasmine Burton, Founder & President, Wish for WASH, https://atltribune.pageflip.site/editions/AT77215#page/33, Atlanta Tribune, Jun. 2018.

London International Development Centre, Blog, Alumni Spotlight: Jasmine Burton, https://lidc.ac.uk/alumni-spotlight-jasmine-burton/?utm_source=twitter&utm_medium=tweet, Jul. 16, 2018.

Providing Clean Water, https://www.rotary.org/en/our-causes/providing-clean-water, Rotary International, downloaded Jun. 24, 2021.

Meet the Woman who Brings Toilets to the Developing World, https://w-insight.com/2018/03/08/jasmine_burton/Winsight, Mar. 8, 2018.

Natasha Rodney, Jasmine Burton: Founder and President of Wish for Wash, http://blogs.lshtm.ac.uk/alumni/2018/02/08/jasmine-burton-founder-president-wish-wash/ London School of Hygiene & Tropical Medicine Alumni Blog, Feb. 8, 2018.

Eleanor Peake, Jasmine Burton is Redesigning Toilets...Because Everybody Poops, https://www.wired.co.uk/article/jasmine-burton-wish-for-wash-toilet-design, Wired UK, Jun. 12, 2017.

Natasha Rodney, Fellowships for Global Health Leaders at Global Health Corps, http://blogs.lshtm.ac.uk/alumni/2017/08/24/fellowships-for-global-health-leaders-at-global-health-corps/ London School of Hygiene & Tropical Medicine Blog, Aug. 24, 2017.

Jasmine's Mobile Toilet is Helping Women Reclaim Dignity in Public, https://sheroes.com/articles/jasmine-s-mobile-toilet-is-helping-women-reclaim-dignity-in-public/NTMxNA==, SHEROES, Jun. 3, 2017.

Jessica Pei, Because #Everybodypoops, https://medium.com/theiq-magazine/because-everybodypoops-409201459a3f#.o8b876r5o, The Innovation Quotient, Oct. 21, 2016.

Kyle Popline, Finding a Sanitation Destiny: 'I Am Supposed to Design Toilets', Next Billion blog—https://nextbillion.net/finding-a-sanitation-destiny-i-am-supposed-to-design-toilets/, NextBillion Health Care, May 5, 2016.

Charlie Gilkey, Changing the Word, One Toilet at a Time With Jasmine Burton, https://www.productiveflourishing.com/podcast/jasmine-burton-2/, The Creative Giant Show, Apr. 12, 2016.

Tracy Leigh Hazzard, How a Young Woman Designer Is Changing the Way the Word Poops, https://www.inc.com/tracy-leigh-hazzard/meet-the-woman-behind-the-worlds-most-innovative-and-life-saving-toilet.html, Inc. Mar. 30, 2016.

Parija Kavilanz, This Plastic Toilet Could Save Lives, https://money.cnn.com/2016/01/22/smallbusiness/safichoo-toilet-jasmine-burton/index.html?iid=hp-stack-dom, CNN Money, Jan. 22, 2016.

Shiba Kurian, Maximum Design for Minimum Disease, http://www.thehindu.com/features/magazine/shiba-kurian-on-safichoo-a-mobile-toilet-for-the-developing-world/article8004904.ece, The Hindu, Dec. 19, 2015.

Ann Brown, Girls in the Developing World Often Drop Out of School Due to a Lack of Toilets, Wish for Wash Is Changing That, https://madamenoire.com/603159/wish-for-wash/, Madamnoire, Dec. 10, 2015.

Kristyn Back, Wish for Wash / Changing the World One Toilet at a Time, https://hypepotamus.com/companies/wish-wash/, Hypepotamus, Dec. 1, 2015.

Ben Schiller, A Toilet Kit for the Developing World That Adapts Your Favorite "Position," https://www.fastcompany.com/3053034/a-toilet-kit-for-the-developing-world-that-adapts-your-favorite-position, Fast Company, Nov. 24, 2015.

Meet a Cool Girltanker: Jasmine Kaila from Atlanta, http://blog.girltank.org/meet-a-cool-girltanker-jasmine-kaila-from-atlanta/ Girltank, Nov. 23, 2015.

How One Industrial Designer Revolutionizes Community Health, https://blog.about.me/2015/11/16/jasmine-burton/About.Me, Nov. 16, 2015.

Maria Dieter, Improving Sanitation Through Empathic Design: Meet Jasmine Burton, A PSI Global Health Corps Fellow, https://www.psi.org/2015/07/improving-sanitation-through-empathic-design-meet-jasmine-burton-a-psi-global-health-corps-fellow/PSI, Jul. 28, 2015.

(56) References Cited

OTHER PUBLICATIONS

Adventures With InVenture: PHH's Intern Takes on Sanitation Design, https://www.phii.org/phii-voices/adventures-in-inventure, Public Health Informatics Institute, Apr. 23, 2014.
Startup Daze Podcast Transcript—https://www.iheart.com/podcast/256-startup-daze-31129803/episode/episode-4-jasmine-burton-wish-for-41264696/Startup Daze—https://www.iheart.com/podcast/256-startup-daze-31129803/episode/episode-4-jasmine-burton-wish-for-41264696/ Aug. 24, 2018.
WSB-TV Georgia Game Changers Ep 2—Video transcript and screen shots https://www.wsbtv.com/video?videoId=664480846&videoVersion=1, available Jul. 22, 2018.
A Celebration of Female Entrepreneurs—Video Transcript and screen shots https://www.indiegogo.com/campaign_collections/a-celebration-of-female-entrepreneurs, Dec. 20, 2015.
The Culture-ist Magazine https://www.thecultureist.com/2015/12/01/how-the-safichoo-toilet-can-eliminate-stigmas-and-disease-in-impoverished-communities/, Dec. 1, 2015.
Jezebel Blog—https://modernluxury.com/jezebel/story/trailblazing-10, Jul. 21, 2015.
Georgia Tech Industrial Design Feature—Meet Jasmine Burton, Industrial Design Student, Video transcript and screen shots https://www.youtube.com/watch?v=mEUbtUC7aTQ, Nov. 13, 2014.
CDC World Water Day 2014 Blog—https://blogs.cdc.gov/global/2014/03/17/saving-energy-saving-lives-world-water-day-2014/ Mar. 17, 2014.

* cited by examiner

MODULAR TOILET SYSTEMS AND METHODS

CROSS-REFERENCE TO RELATED APPLICATIONS

This application claims the benefit of U.S. Provisional Patent Application No. 62/969,314, filed on Feb. 3, 2020.

INCORPORATION BY REFERENCE

The disclosure of U.S. Provisional Patent Application No. 62/969,314, filed on Feb. 3, 2020, is hereby incorporated by reference for all purposes as if presented herein in its entirety.

TECHNICAL FIELD

The present disclosure relates to sanitation systems, and in particular, to modular toilet systems and methods. Other aspects also are described.

BACKGROUND

Every living person in the world must urinate and defecate. Unfortunately, many people in the world do not have access to hygienic toilets and many more do not have access to safely managed sanitation. In reality, open defecation is widely practiced, leading to fecal contamination of the environment, which can lead to health hazards, mental anguish, violence, etc. While these impacts can be mitigated by establishing standards of safer toilet systems implemented in resource constrained communities around the world, a holistic approach to sanitary management requires understanding of cultural norms and preferences. Current improvements in toilet systems tend to focus on improving sanitary and sewerage aspects of the toilet system, while largely ignoring cultural norms and user preferences. Implementing toilets that do not address user preferences leads to a host of product misuse, which is evidenced by the number of toilets that are transformed into glorified flower pots or sold because many communities will not use something that may not meet their cultural needs. Therefore, there is a continuing need for sanitary toilet options that are easily deployable by customers; are universal, e.g., are reconfigurable to be culturally specific with various options that enable end users to choose how to best meet their preferences/cultural needs; can be safely used by people of all abilities; are aspirational by promoting both hygiene and dignity; and which also allow users to make small incremental investments to move up the sanitation value chain. The present disclosure addresses the foregoing and other related and unrelated problems/issues in the art.

SUMMARY

Briefly described, the present disclosure is, in one aspect, directed to a sanitary, modular toilet assembly or system. The toilet system generally includes a toilet seat, one or more risers, one or more inserts, and a base or floor component. The toilet seat is configured for sitting or squatting and is connectable to the one or more risers and/or the base. The one or more risers are connectable to the toilet seat and base to elevate or raise the toilet seat to a desired/predetermined sitting or squatting height. The base is configured to communicate with a receptacle, e.g., a container, hole in the ground, a septic tank, etc. and/or a waste collection unit for collection of waste, e.g., urine, feces, etc., disposed in the toilet system.

The toilet seat has a top or upper portion or surface configured to allow users to sit or squat on the toilet seat. The toilet seat also includes an opening defined therethrough configured to receive and facilitate the capture of human waste when the user sits on or squats over the toilet seat and defecates or urinates. The toilet seat also includes a bottom end with one or more engagement or attachment features or portions configured to secure the toilet seat to the base and/or the one or more risers.

The riser(s) generally is configured to support and elevate the toilet seat. The top end of the riser(s) further includes one or more attachment portions or features that cooperate or otherwise communicate with the one or more attachment portions or features of the toilet seat to facilitate connection between the toilet seat and the one or more risers. The top end of the riser(s) further can be configured to allow a user to sit or squat thereon. The riser(s) also includes a contoured opening configured to be substantially aligned with the contoured opening of the toilet seat when the riser is attached thereto. A bottom end of the riser(s) can include one or more attachment portions or features configured to attach the riser(s) to the base or other components/portions of the toilet system.

The base generally includes a top end with one or more attachment portions or features that are configured to cooperate or otherwise communicate with the one or more attachment portions of the riser(s) and/or the one or more attachment portions of the toilet seat to facilitate connection of the riser(s) and/or the toilet seat and the base. The top end of the base further can be configured such that users can squat over the base for urination or defecation. The base also includes a contoured opening configured to be substantially aligned with the contoured opening of the toilet seat and/or the contoured opening of the riser(s) when the toilet seat and/or the riser(s) are attached to the base. The base further includes a bottom end that may be installed underground or above ground and configured to communicate with (e.g., via the contoured opening of the base) a septic system, a waste collection bin/container, a hole in the ground, etc., to facilitate safe collections of human waste.

Accordingly, the toilet seat, base, and/or riser(s) can be selectively connectable, such that the toilet system can be assembled in, and/or is reconfigurable between, a plurality of configurations. For example, in one configuration, the riser(s) can be attached to the base and the toilet seat can be attached to the riser(s) for a seated toilet configuration. In another configuration, the toilet seat can be directly attached to the base allowing the use of the modular sanitary toilet in a squat toilet configuration. In another configuration, users may sit or squat directly over/on the top end of the base to urinate or defecate, without attaching the riser or the toilet seat thereto. In an even further configuration, the user of the modular sanitary toilet assembly may use the riser(s) attached to the base and sit on or squat over the riser(s) to urinate or defecate, without attaching the toilet seat thereto.

In addition, the toilet assembly further may include one or more removable and/or replaceable inserts that are configured to be received within the contoured openings of the toilet seat, the riser(s), and/or the base, e.g., to configure the toilet assembly for specific functionality, operations, waste management needs, etc. The inserts can include a septic or sewage connection insert that enables connection of the toilet system to a septic or sewerage line thus enabling the toilet system to act as a flushing toilet; pour flush insert with a liquid trapping mechanism, configured to allow for the toilet system to be used as a pour flush toilet thus enabling manual flushing and mitigating smell; and/or a waste separation or urine diverting insert configured to separate urine and fecal matter thus enabling the toilet system to operate as a dry or compost or similar off-grid waterless toilet structure.

In one embodiment, the septic or sewer connection insert includes an insert body that is sized, dimensioned, and/or configured to be at least partially received within the contoured openings of the toilet seat, riser(s), and/or base. The septic or sewer connection insert body includes a cavity or chamber defined therein and configured to receive human waste from users of the toilet system. The septic or sewer connection insert body further has an opening in communication with the chamber that allows for the receipt of human waste therethrough and into the chamber of the insert body. The septic or sewer connection insert body further includes a back or rear hole defined therethrough that is configured to connect to a flush tank, and a bottom or lower hole at a base of the insert body that is configured to be connected to a septic or sewage pipeline. Accordingly, the flush tank can be activated to evacuate or flush waste collected within the chamber of the septic or sewer connection insert body through and out of the bottom hole therein to the septic or sewage pipeline. The connection of a septic or sewage pipeline may be optional, however, and the septic/sewer connection insert may be used with a hole in the floor, such as for composting, or other suitable waste collection, bin, container, etc.

In one embodiment, the pour flush insert can enable users to utilize prescribed amounts of water or other liquid, such as about 2 to 3 liters, to manually flush waste, e.g., to mitigate water use in water extreme communities and/or if the users are unable to afford reoccurring costs of municipal sewage/flushing systems. The pour flush insert can include a pour flush insert body that is an insert body that is configured to be received within the contoured openings of the toilet seat, riser(s), or base. The pour flush insert body can include a chamber or cavity defined therein for waste collection, and an opening defined in a bottom portion of the chamber or cavity that is in communication with an arched or curved piping extending from the bottom portion of the pour flush insert body. The arched or curved piping receives waste, e.g., through the opening in the bottom portion, and is configured to at least temporarily keep/contain some liquid (e.g., water, urine, etc.) trapped within the base and/or the arched or curved piping of the pour flush insert body, e.g., to facilitate the trapping or reducing odor or smells within the system to make the user experience more enjoyable (such as by reducing flies, bad odor, etc.).

Typically, the pour flush insert is used over a waste chamber that is either above or below ground, e.g., cement or plastic box or septic tank, etc., and can be evacuated by a septic tank vacuum, a vacuum truck or manual fecal sludge management operation system or other similar waste management and evacuation methods. In this regard, the pour flush insert further may improve the waste management operator's (e.g., the operator of the vacuum truck) experience by keeping the waste wet thus enabling it to be collected with ease (in contrast to dry toilets in which waste is compacted and hard to remove from pits, latrines, or regular pit latrine toilets where trash such as diapers, clogs, or waste vacuum operations). Furthermore, the opening that is in communication with the arched or curved piping can have a reduced area, size, dimensions, etc., e.g., to help to mitigate the amount of solid waste, such as diapers, trash, etc., that may be placed into the toilet system.

In one embodiment, the waste separating insert can include a waste separating insert body that is configured to be received within the contoured openings of the toilet seat, riser(s), or base. The insert body generally includes a first portion or area with a plurality of holes or openings that are sized to allow for the passage of urine, but substantially block, prevent, reduce, or inhibit the passage of feces or other solids. The insert body further can include a second portion or area substantially adjacent the first area with a hole or aperture that is sized to allow for the passage of feces or other suitable solid waste therethrough. Users therefore can obtain and use multiple chambers or buckets to correspond to the holes for the passage of urine and/or the hole for the passage of feces so that urine and feces can be separated into various buckets or collection bins. In this regard, the waste separating insert can facilitate or enable a user to compost their waste; separate urine or feces for reuse in other ways within their homes and communities, such as in the form of biochar, biogas; use urine as a form of irrigation, etc. Other inserts could also be developed for other use cases including but not limited to an internal toilet lid or biomedical/biosensor monitoring.

According to one aspect of the present disclosure, a toilet system comprises a toilet seat that is configured for a user to sit on or squat over for depositing of human waste, and includes a toilet seat body with a toilet seat opening for receipt of the human waste and one or more seat attachment portions configured to attach the toilet seat to various components of the toilet seat system. The toilet system further comprises a riser that is configured to support and elevate the toilet seat to a selected or prescribed height, and includes a riser body with a riser opening defined therein for receipt of the human waste, and a first riser attachment portion and a second riser attachment portion, the first riser attachment portion being connectable to one or more seat attachment portions of the toilet seat. The toilet system further comprises a base including a base body that has a base opening for receipt of human waste and a base attachment portion that is connectable to the second riser attachment portion of the riser and/or the one or more seat attachment portions of the toilet seat, and a plurality of removable, interchangeable inserts configured to be at least partially received within the riser opening and/or the base opening, to allow for reconfiguration of the toilet system for performance of various functions or operations.

According to another aspect of the present disclosure, a method comprises obtaining a toilet seat, a riser, and a base, positioning the base along a ground or floor, connecting the riser to the base by engaging a first riser attachment portion of the riser with a base attachment portion of the base, selecting an insert of a plurality of removable, interchangeable inserts and positioning the insert at least partially within a riser opening in the riser, the inserts of the plurality of inserts being configured to allow for reconfiguration of the toilet system for performance of various functions or operations, and connecting the toilet seat to the riser by engaging a seat attachment portion of the toilet seat with a second riser attachment portion of the riser.

Various objects, features and advantages of the present invention will become apparent to those skilled in the art upon a review of the following detail description, when taken in conjunction with the accompanying drawings.

BRIEF DESCRIPTION OF THE FIGURES

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

DETAILED DESCRIPTION

Figure 1:
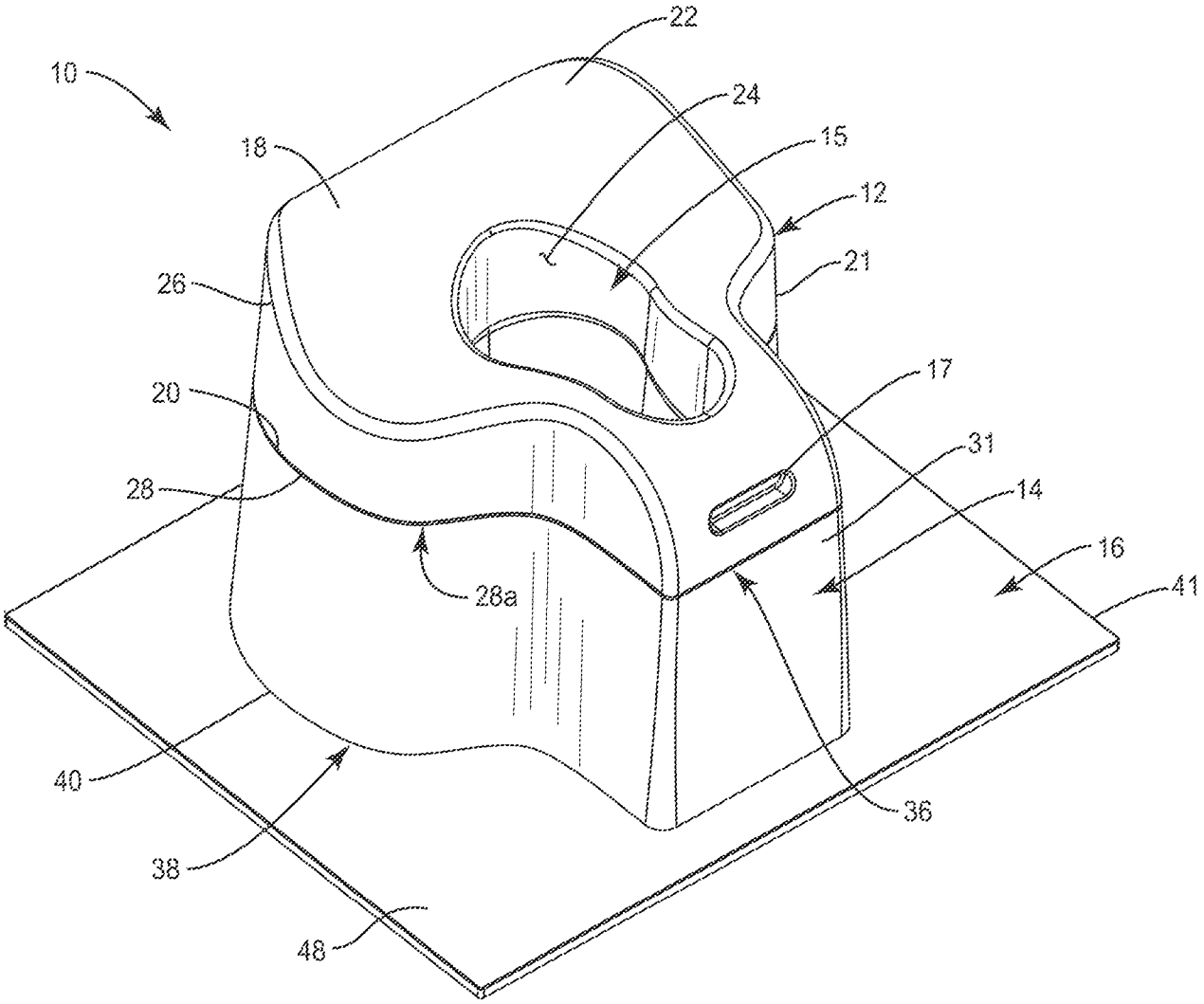
FIG. 1 provides a perspective view of a modular toilet assembly according to principles of the present disclosure.

In general, as shown in FIGS. 1-15, the present disclosure is directed to a modular, sanitary toilet assembly or system 10 that is selectively reconfigurable between a plurality of configurations or arrangements to meet a user's sanitation needs, cultural or traditional preferences/practices, etc. The modular toilet assembly 10 generally includes a toilet seat 12, one or more risers 14, a base or floor component 16, and one or more inserts 50. The toilet seat 12 generally is configured to allow a user to sit on or squat over the toilet seat 12 for defecation or urination. The base 16 generally is configured to be positioned on or attached to the ground or flooring. The one or more risers 14 are generally configured to raise the toilet seat 12 to a prescribed height (such as a comfortable sitting height for average users of a particular region). The toilet seat 12 is configured to be connectable to the riser base 14, which further can be attached to the base 16, such that the base 16, the riser 14, and the toilet seat 12 are substantially aligned with one another. The modular toilet assembly 10 further includes a common opening 15 configured to receive human waste from the user. The common opening 15 generally extends through the toilet seat 12, the base 16, and the riser(s) 14.

Figure 11:
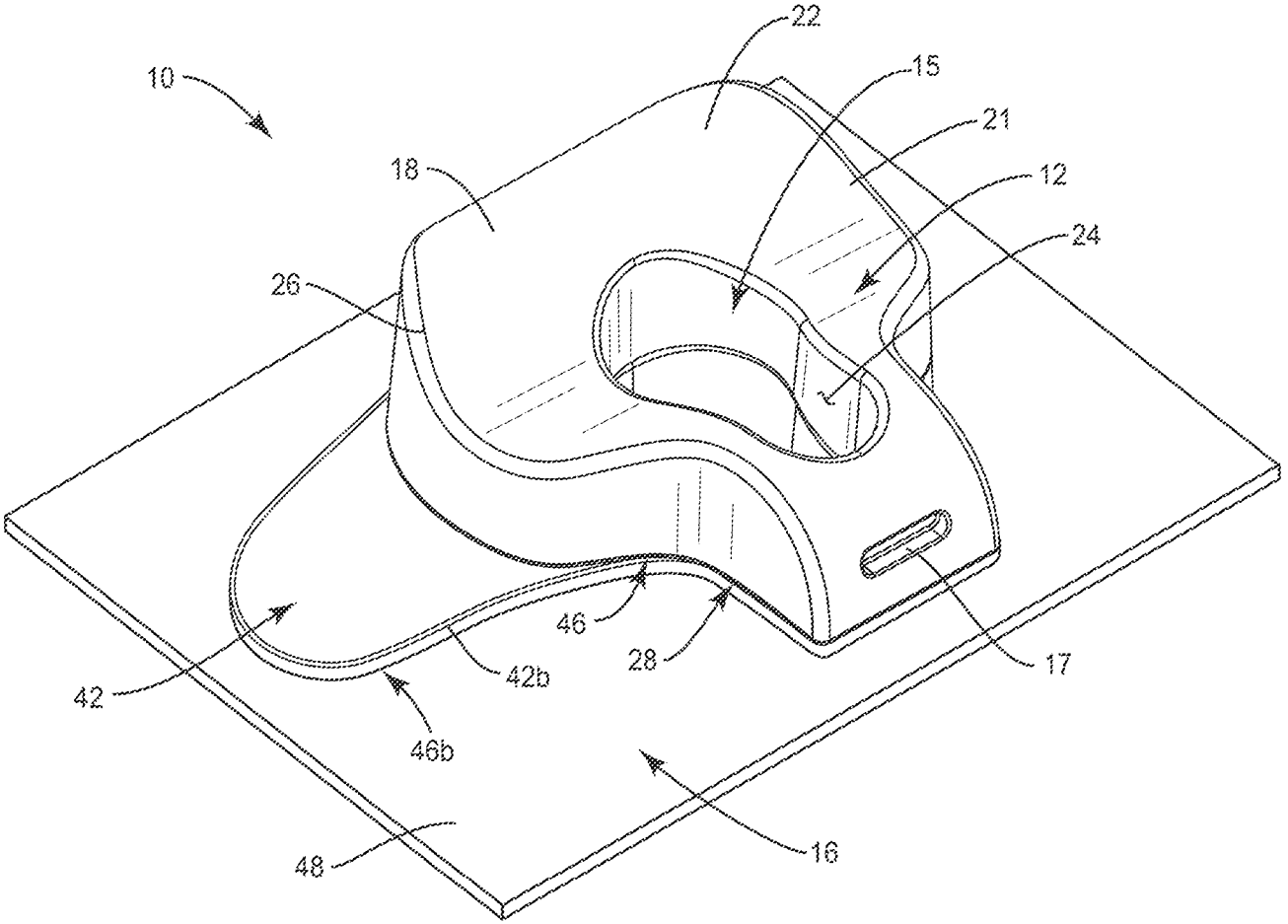
FIG. 11 provides a perspective view of the modular sanitary toilet assembly of FIG. 2 in a squat configuration according to principles of the present disclosure.
Figure 12:
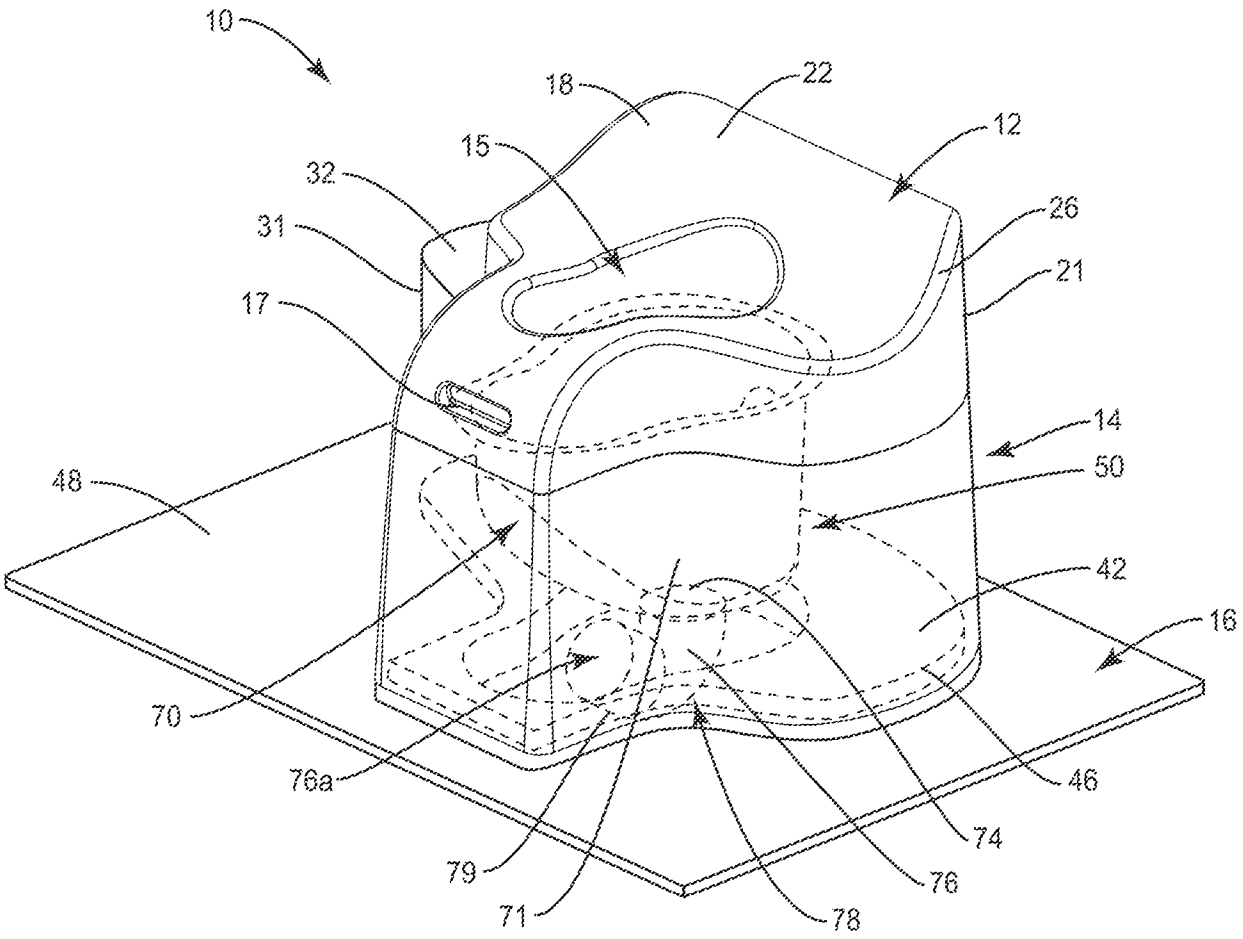
FIG. 12 provides a perspective view of a modular sanitary toilet assembly with a pour flush insert according to principles of the present disclosure.
Figure 13:
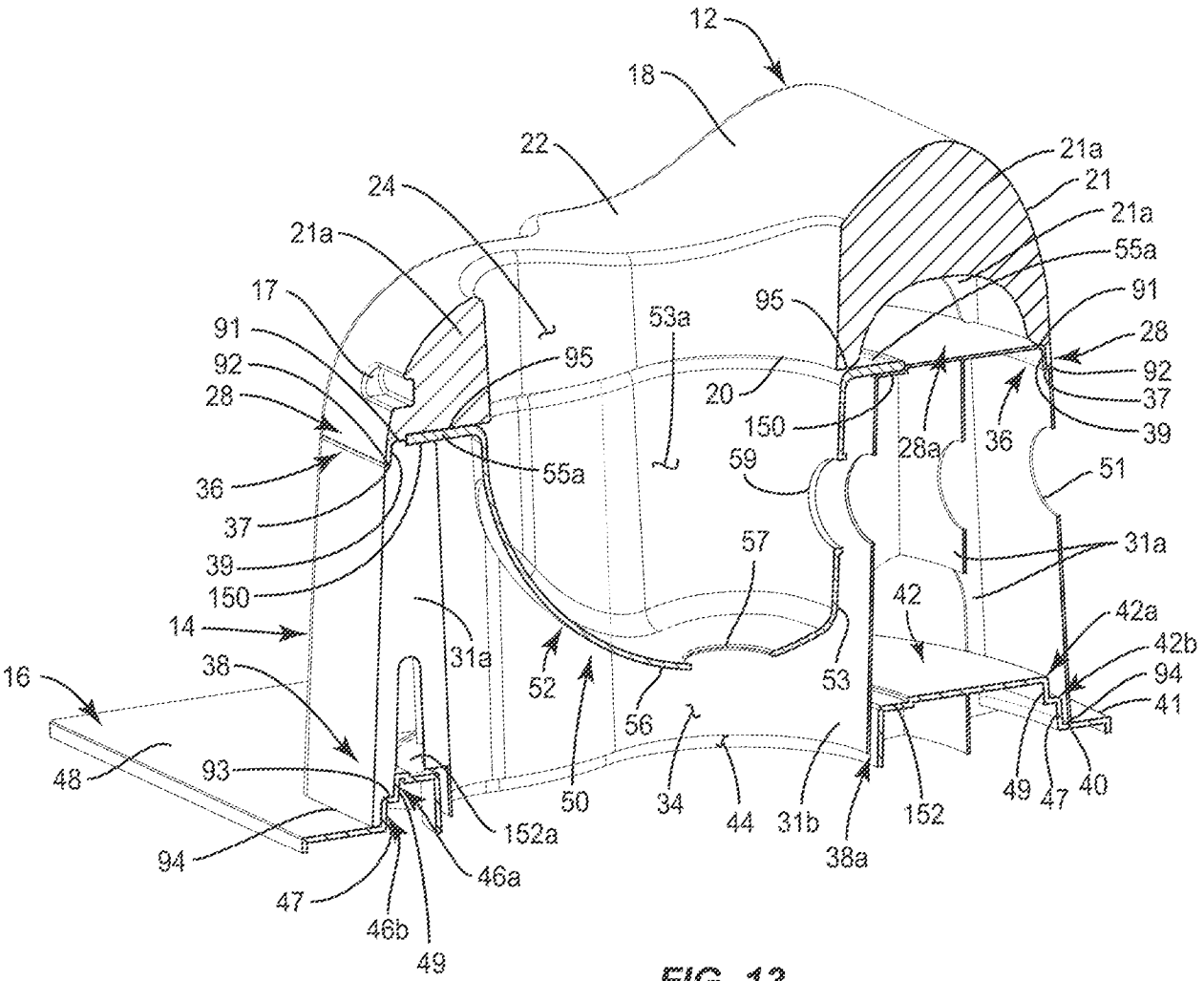
FIG. 13 provides a cross-sectional view of the modular sanitary toilet assembly in a sit type configuration according to principles of the present disclosure.
Figure 14:
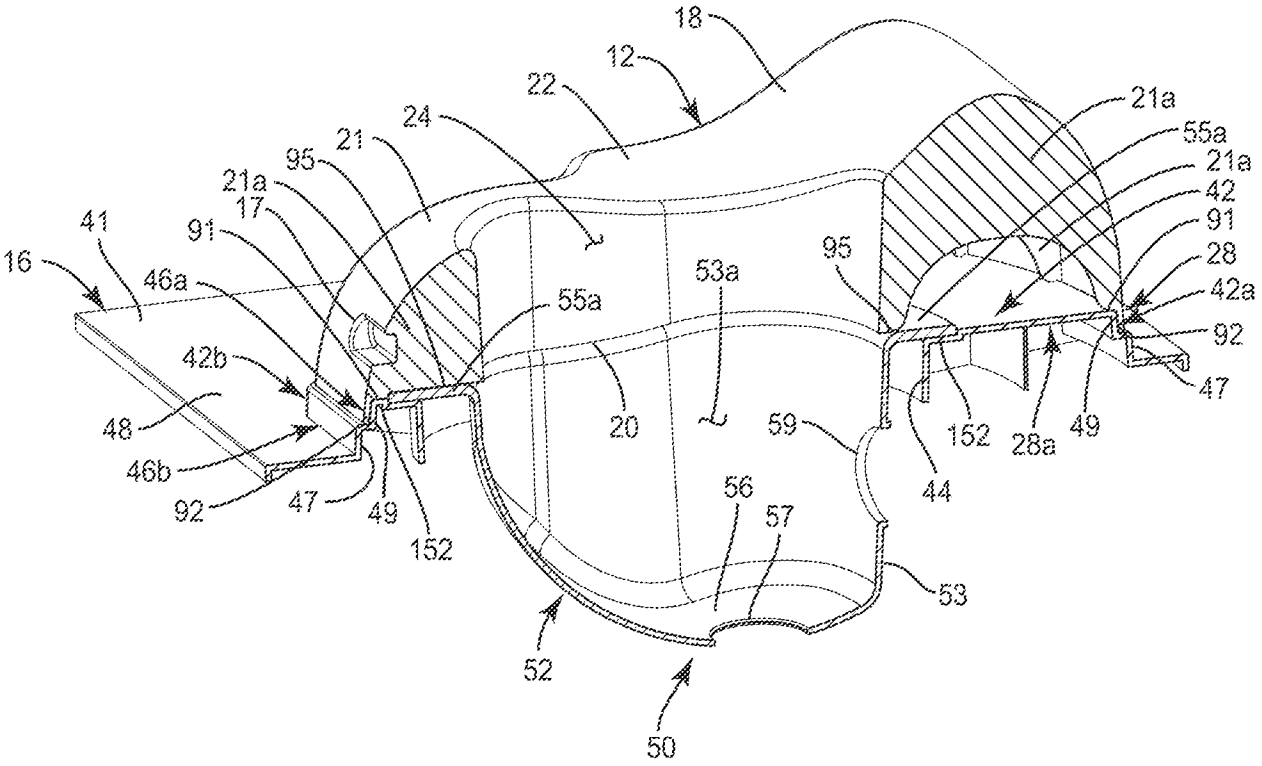
FIG. 14 provides a cross-sectional view of the modular sanitary toilet assembly in a squat type configuration according to principles of the present disclosure.

As generally shown in FIGS. 1-3, 6, and 11-14, the toilet seat 12 includes a toilet seat body 21 having a top end 18 with a seating surface 22 configured to allow a user to sit on or squat over the toilet seat 12. In the illustrated embodiment, the toilet seat body 21 can have a substantially hollow construction; though the toilet seat body 21 can have a solid construction or be formed with one or more substantially solid portions without departing from the scope of the present disclosure. For example, as shown in FIGS. 13 and 14, the toilet seat 12 can have a generally hollow construction and can include a plurality of spaced ribs 21*a* (e.g., seat ribs 21*a*) that are spaced along the underside of the toilet seat 12. In one embodiment, the seat ribs 21*a* can provide structural support to the toilet seat 12. The seating surface 22 of the toilet seat 12 may be sloped, angled, or contoured so as to provide a comfortable or ergonomic seating or squatting experience for users. For example, the seating surface 22 may form a contoured surface that improves user experience and/or comfort, and may be designed to follow the ergonomics of an average male and/or female user in a sitting or squatting position. The seating surface 22, however, may be substantially flat or planar to facilitate a user squatting or hovering over the toilet seat 12 for defecation or urination therein, without departing from the scope of the present disclosure.

Figure 6:
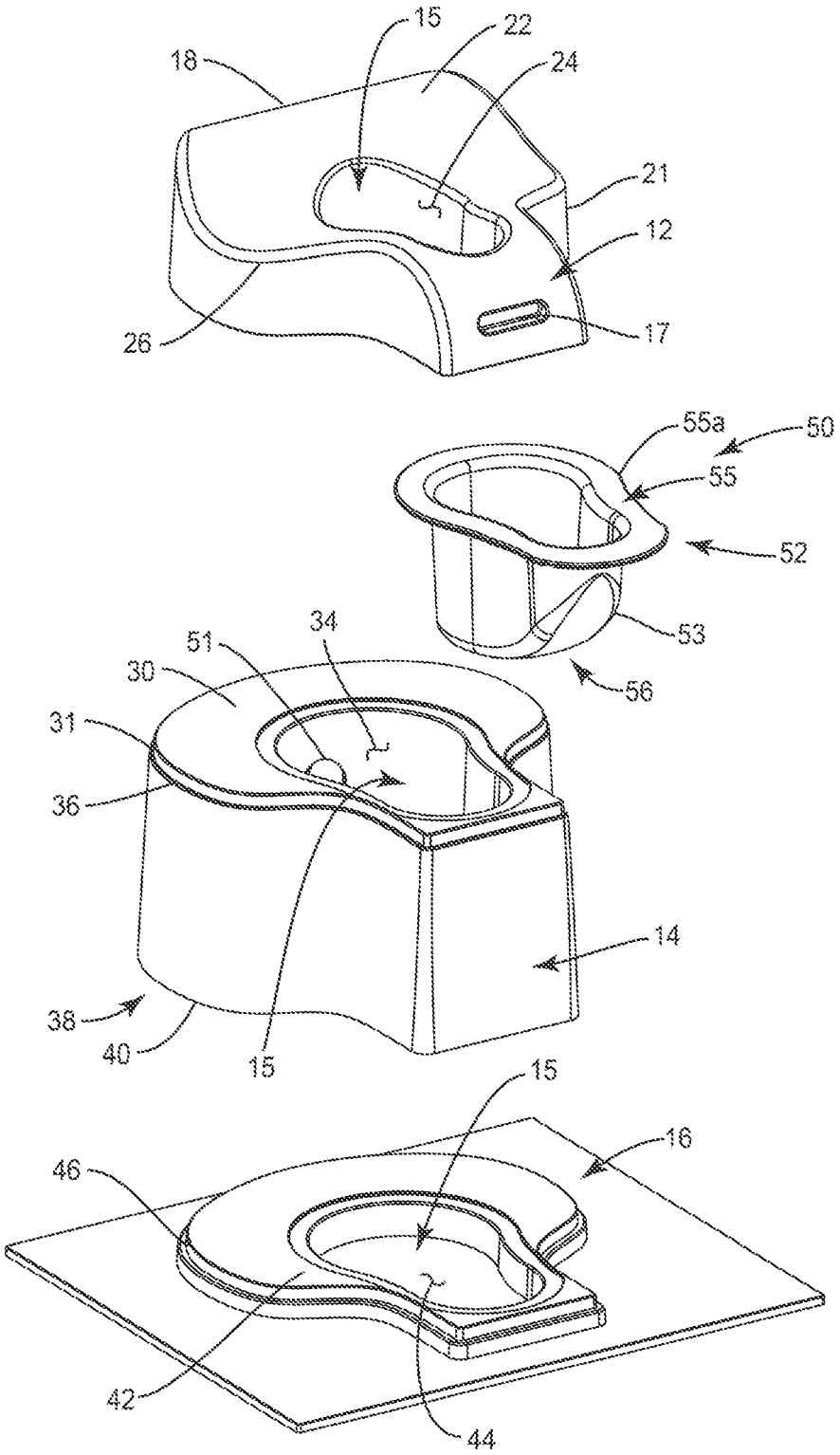
FIG. 6 provides an exploded view of the modular toilet assembly of FIG. 1.

The toilet seat 12 further includes an opening 24 (e.g., an inner seat opening 24) configured to receive human waste when the user sits on or squats over the toilet seat 12 and defecates or urinates (FIGS. 1-3, 6, and 11-14). This opening 24 can make up a section or portion of the common opening 15 of the modular toilet assembly 10, as indicated in FIGS. 1 and 6. In one embodiment, the opening 24 includes a contoured opening 24 that is generally peanut shaped, though the opening 24 can include any suitable shape, e.g., oval, circular, etc., or configuration without departing from the scope of the present disclosure. The opening 24 is generally dimensioned, sized, or otherwise configured to receive and facilitate capture of human waste, e.g., when users hover about 2 inches to about 12 inches over the toilet seat 12 in a squatted posture.

In one embodiment, the toilet seat 12 can have outer dimensions of about 600 to about 750 mm in length by about 600 to about 750 mm in width by about 275 to about 350 mm in height. Further, in one example embodiment, the opening 24 can have a width of about 150 mm to about 250 mm, such as 185 mm. Other outer dimensions, shapes, and sizes, of the toilet seat 12 are possible, however, without departing from the scope of this disclosure. The toilet seat 12 further can be formed from plastic or polymeric materials, such as high density plastics (HDPE, ABS, etc.), though other suitable synthetic, composite, etc. materials (e.g., ceramic, cement, steel, etc.) can be used without departing from the scope of the present disclosure.

In addition, as generally shown in FIGS. 1-3, 13, and 14, the toilet seat 12 may include one or more lower seat attachment portions or features 28 for securing various components of the modular toilet assembly 10 to the toilet seat 12. In one example construction, the lower seat attachment portion(s) 28 can include a seat attachment opening or aperture 28*a* (FIGS. 13 and 14) formed along a bottom end 20 of the toilet seat 12 that can slide over respective connection portions of the riser 14 and/or the base 16 and/or can provide a "snap fit" or frictional connection between the toilet seat 12 and the riser 14 and/or base 16, e.g., when at least a portion of the riser 14 or base 16 is received therein. The lower seat attachment portion 28 further can include other engagement features or fastening mechanisms, such as fasteners, hooks, or other locking mechanisms, without departing from the scope of the present disclosure. For example, the toilet seat 12 further can have one or more locking ridges or protuberances along this opening to help to facilitate the "snap fit" connection between the toilet seat 12 and other components of the modular toilet assembly 10.

In the illustrated embodiment, the toilet seat 12 further can include a stacking aid 26 (FIGS. 1 and 3) that can cooperate with a lower seat attachment portion 28 or other component of another toilet seat to allow several toilet seats to be stacked on top of each other, e.g., for ease of transportation and storage.

Figure 2:
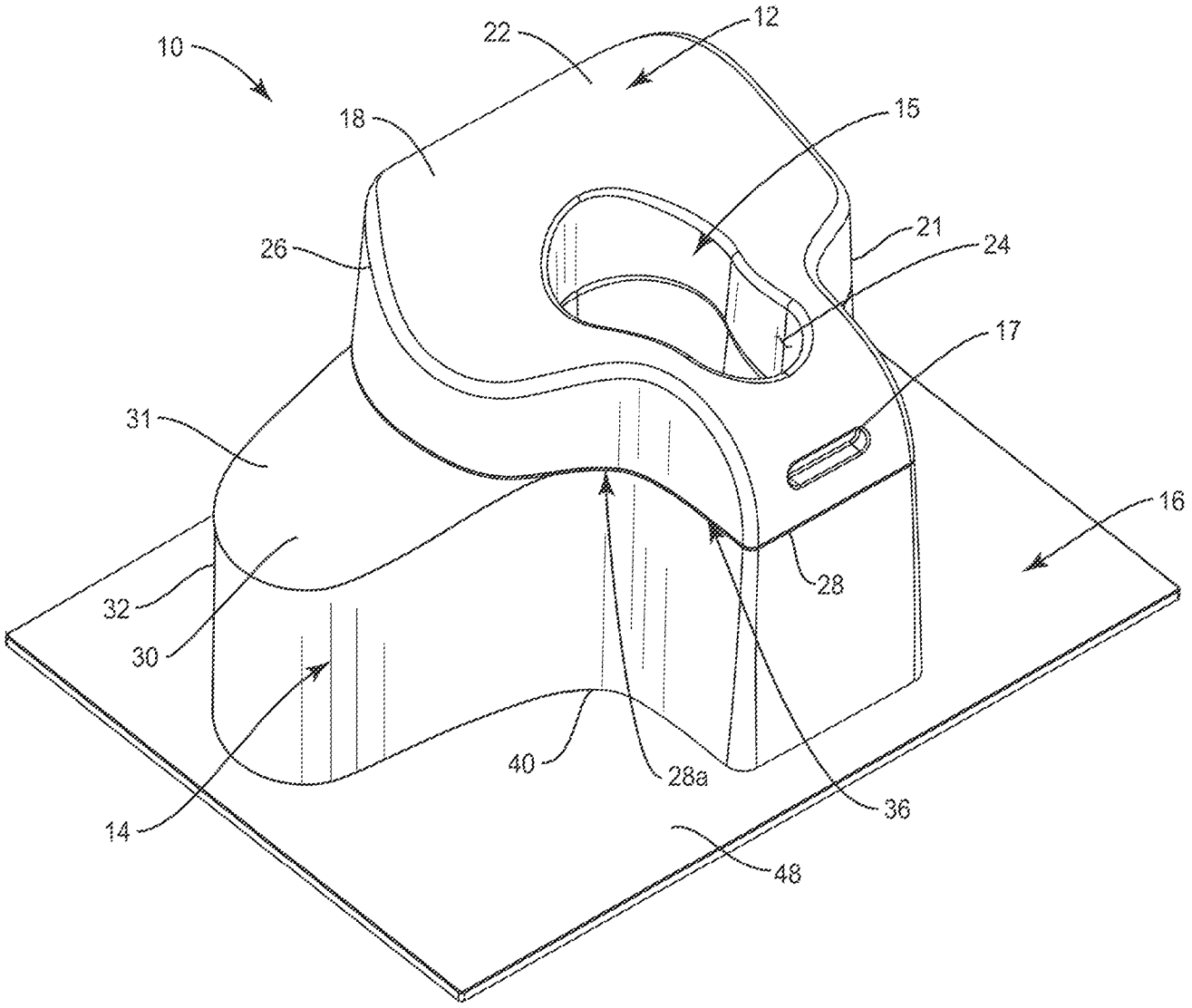
FIG. 2 provides a perspective view of an alternative modular toilet assembly according to principles of the present disclosure.
Figure 3:
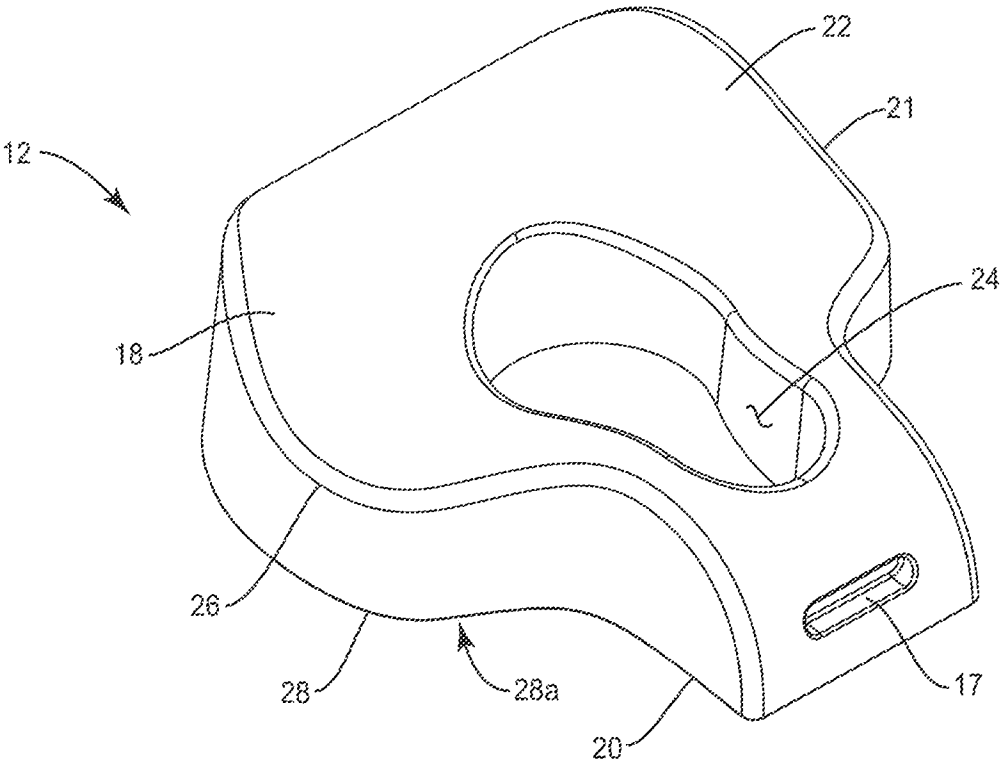
FIG. 3 provides a perspective view of a toilet seat of the modular toilet assembly of FIG. 1.

In one embodiment, the toilet seat 12 additionally can include a handle or engagement portion 17 defined in or otherwise provided along a forward portion of the toilet seat body 21. The handle 17 generally is configured to help facilitate carrying, transporting, or moving the toilet seat 12. As generally indicated in FIGS. 1-3, the handle 17 may be located on a front surface of the body 21 of the toilet seat 12, and can be formed as a slot or notch that is defined in the body 21 of the toilet seat 12, though the handle 17 may be located in any suitable surface or portions, e.g., rear or side portions, of the toilet seat body 21. In alternative constructions, the handle 17 can include a protruding handle or other external engagement portion having any suitable shape, size, and/or configuration without departing from the present disclosure.

As additionally shown in FIGS. 1, 2, 4, 6, 12, and 13, the modular toilet assembly 10 further can include one or more risers 14. A riser 14 generally can be configured to support and elevate the toilet seat 12 to a desired seating or squatting height. The riser 14 includes a body 31 with a top end 30 that is configured to be connectable to the toilet seat 12. The riser body 31 may have a substantially hollow structure, though the riser 14 may include a substantially solid structure or substantially solid portions without departing from the scope of disclosure. For example, as shown in FIG. 13, the riser 14 can have a generally hollow construction and can include a plurality of spaced ribs 31*a* (e.g., riser ribs 31*a*) that are spaced along the underside of the riser 14. In one embodiment, the riser ribs 31*a* can provide structural support to the riser 14. FIGS. 1 and 6 generally show that the exterior profile of the riser 14 can generally follow or conform to the shape and size of the toilet seat 12; however, other shapes, sizes and configurations of the riser 14 are possible, without departing from the scope of the present disclosure. For example, as indicated in FIGS. 2 and 12, the riser body 31 may include a ledge or other protrusion or extending portion 32 with a profile that extends outside the profile of the toilet seat 12. The ledge 32 may be used as a support; a climbing aid, a storage space, etc.

Figure 4:
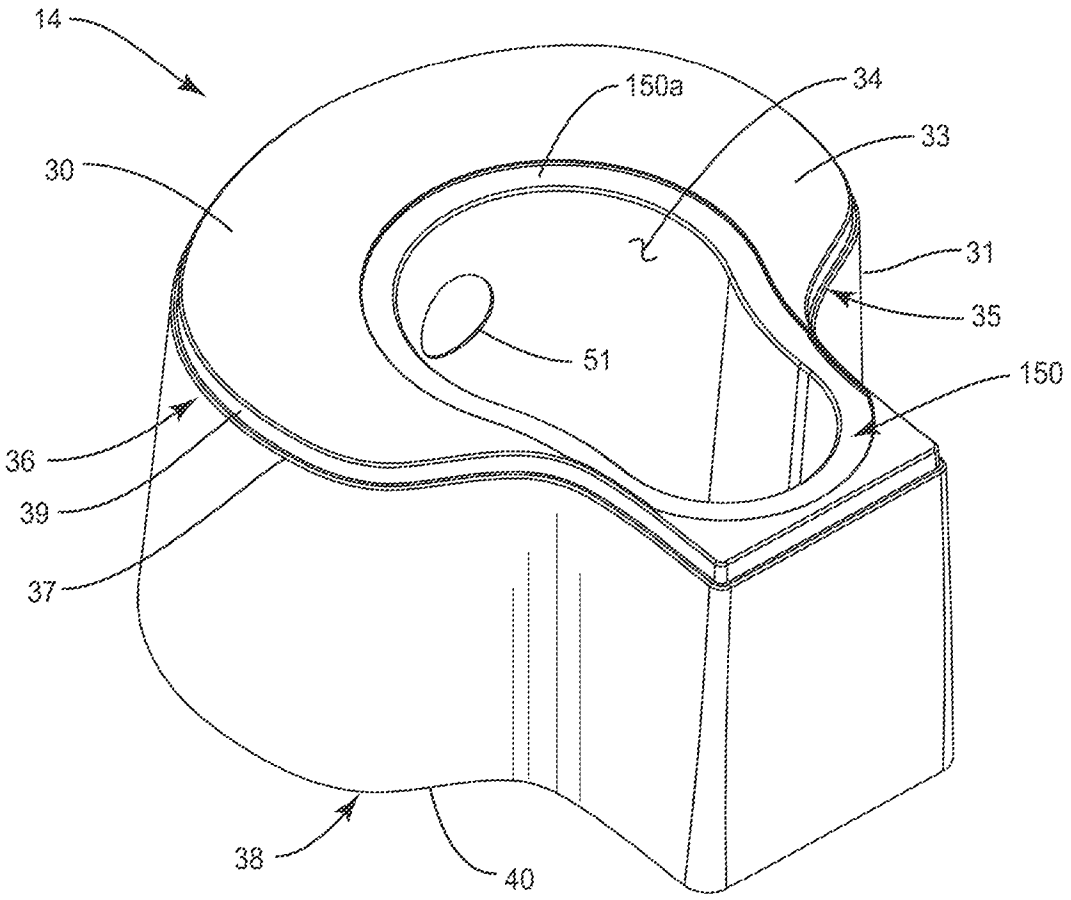
FIG. 4 provides a perspective view of a riser of the modular toilet assembly of FIG. 1.

FIGS. 1, 2, 4, 6, 12, and 15 further show that the top end 30 of the riser 14 generally is configured to be attached to the bottom end 20 of the toilet seat 12. Furthermore, the top end 30 of the riser 14 can define a seating surface 33 that is configured to allow for a user to sit on or squat over the riser 14 to defecate/urinate, for example, when the toilet seat 12 is not used, desired, etc. The top end 30 of the riser 14 further includes one or more upper riser attachment portions or features 36 (e.g., a first attachment portion 36) that are configured to cooperate with the lower seat attachment portions 28 of the toilet seat 12 to releasably connect or secure the toilet seat 12 to the riser 14. The upper riser attachment portion 36 of the riser 14 may include a notch or recess defined in/along the top portion 30 of the riser body 31 that provides a shoulder or surface(s) 35 having a lower portion or surface 37 and an upper portion or surface 39 (e.g., as indicated in FIG. 4) that are configured to cooperate with the seat attachment opening 28*a* of the bottom end 20 of the toilet seat 12 to facilitate a substantially secure, removable connection between the toilet seat 12 and the riser 14 (e.g., as shown in FIG. 13). That is, the lower seat attachment portion 28 of the toilet seat body 21, which is adjacent or proximate the seat attachment opening 28*a*, can engage (e.g., slidingly and/or frictionally engage) or contact the shoulder 35 to releasably secure the toilet seat body 21 to the riser body 31. The upper riser attachment portion 36 also may be used as a stacking aid to stack risers 14 during transportation or storage thereof. Other fastening mechanisms, locking features, such as hooks, fasteners, protuberances, etc., may be incorporated with the upper riser attachment portion 36 to facilitate a substantially secure connection between the riser 14 and other components of the assembly 10, without departing from the scope of the present disclosure.

As shown in FIGS. 4 and 6, the riser 14 further includes an opening 34 (e.g., an inner riser opening 34) that is configured to correspond to the opening 24 of the toilet seat 12 when the riser 14 is attached to the toilet seat 12 to facilitate the receipt and capture of human waste. The opening 34 can be a section or portion of the common opening 15. The opening 34 can include a contoured opening 34 that is generally peanut shaped, although the opening can include any suitable shapes or configurations, e.g., circular, oval, etc., without departing from the scope of the present disclosure. As shown in FIG. 6, the opening 34 further is configured to correspond with an opening 44 of the base 16. That is, when the riser 14 is attached to the toilet seat 12 and the base 16, the opening 34 is substantially aligned with and in communication with the opening 24 of the toilet seat 12 and the opening 44 of the base 16 (forming opening 15) (FIGS. 1 and 6) to receive and facilitate capture of or otherwise allow for collection of human waste from user's using the assembly 10. The riser 14 does not have to be used with the toilet seat 12, however, and can be used in conjunction with the base 16 and/or on its own to facilitate the capture and collection of human waste.

In the illustrated embodiment, the riser 14 further includes a bottom or lower end 40 with one or more lower riser attachment portions or features 38 configured to attach the riser 14 to the base 16, or other components of the modular toilet assembly 10. The lower or second riser attachment portion(s) 38 can include an opening 38*a* (FIG. 13) at the bottom end 40 of the riser 14 that is configured to at least partially receive a portion of the base 16. The lower riser attachment portion 38 of the riser 14 may facilitate a sliding engagement, a snap-fit, an interference fit, a frictional connection mechanism or other suitable engagement between the riser 14 and the base 16. In some embodiments, two or more risers 14 can be stacked, e.g., so that the lower riser attachment portion 38 at the bottom end 40 of one riser 14 engages the upper riser attachment portion 36 at the top end 30 of another riser 14. Other locking or fastening mechanisms, e.g., hooks, fasteners, etc., however, may be incorporated with the lower riser engagement portion 38, without departing from the scope of this disclosure.

FIGS. 4 and 6 further show that the riser 14 can include an opening, aperture, port, etc. 51 that is configured to be connected to a flush tank or other flushing system to received pressurized liquid to flush or otherwise evacuate the toilet assembly when an insert 50 that enables flushing is received, connected, etc. within the riser 14.

In the illustrated embodiments, the modular toilet assembly 10 includes a single riser 14 configured to connect to the toilet seat 12 and the base 16, e.g., to raise the toilet seat 12 to a selected/desired height about the base 16. However, in additional or alternative embodiments, the modular toilet assembly 10 can include a plurality of risers 14 that can be connectable in series to raise the toilet seat 12 to various selected or variable heights. That is, more or fewer risers 14 can be stacked to change or vary the height of the toilet seat 12, e.g., to accommodate users of various heights, sizes, etc.

In one embodiment, the riser 14 (or risers) can have a height of about 200 mm to about 550 mm, such as 330 mm, though other suitable heights or dimensions can be employed without departing from the scope of the present disclosure. The riser 14 further can be formed from plastic or other polymeric materials, such as high density plastics (e.g., HDPE, ABS, etc.), though other suitable materials, such as synthetics, composites, etc., materials (such as ceramic, cement, steel, etc.) can be used without departing from the scope of the present disclosure.

In addition, FIGS. 1, 2, 5, 6, and 11-14 show that the modular toilet assembly 10 further includes a base or floor component 16. The base 16 generally includes a base body 41 with a platform or support structure 48 configured to stably support the riser 14 and/or the toilet seat 12 attached thereto, e.g., such that the riser 14 and/or toilet seat 12 do not tip or fall over when supporting or otherwise being engaged by a user. The platform 48 generally is configured to rest on and/or attach to a flooring, such as a flooring made of concrete, wood, etc. or directly on a ground surface. The platform 48 generally has substantially planar rectangular surface, though the platform 48 may be otherwise shaped, sized, and/or configured, e.g., with one or more arcuate or curved portions, without departing from the disclosure. In one embodiment, the platform 48 can have a width of about 800 mm to about 100 mm, such as 890 mm, and a length of about 750 mm to about 900 mm, such as about 782 mm, though other suitable dimensions can be employed without departing from the scope of the present disclosure.

In the illustrated embodiment, the base 16 further includes an opening 44 (e.g. an inner base opening 44) defined therethrough configured to facilitate capture of human waste. The opening 44 is configured to facilitate attachment to a septic system, a sewer system, a waste collection bin, or a hole in the ground for collection of human waste. The opening 44 can include a contoured opening 44 with a generally peanut shape that generally corresponds to the openings 24 or 34 of the toilet seat 12 or the riser 14, though the opening 44 can include any suitable shapes, e.g., oval, circular, etc., without departing from the present disclosure. As shown in FIGS. 1 and 6, the opening 44 can form a section or portion of the common opening 15. When the base 16 is used with the toilet seat 12 placed directly on the base 16 (e.g., FIGS. 11 and 14), the opening 44 is substantially aligned with the opening 24 of the toilet seat 12, and when the riser 14 is attached to the base 16 and the toilet seat 12 (e.g., FIGS. 1, 2, 6, 12, and 13), the opening 44 is substantially aligned with the openings 24 and 34 of the toilet seat and riser 14 respectively to facilitate the capture and collection of human waste when the user sits on or squats over the toilet seat 12, riser 14, or base 16 and defecates or urinates.

Figure 5:
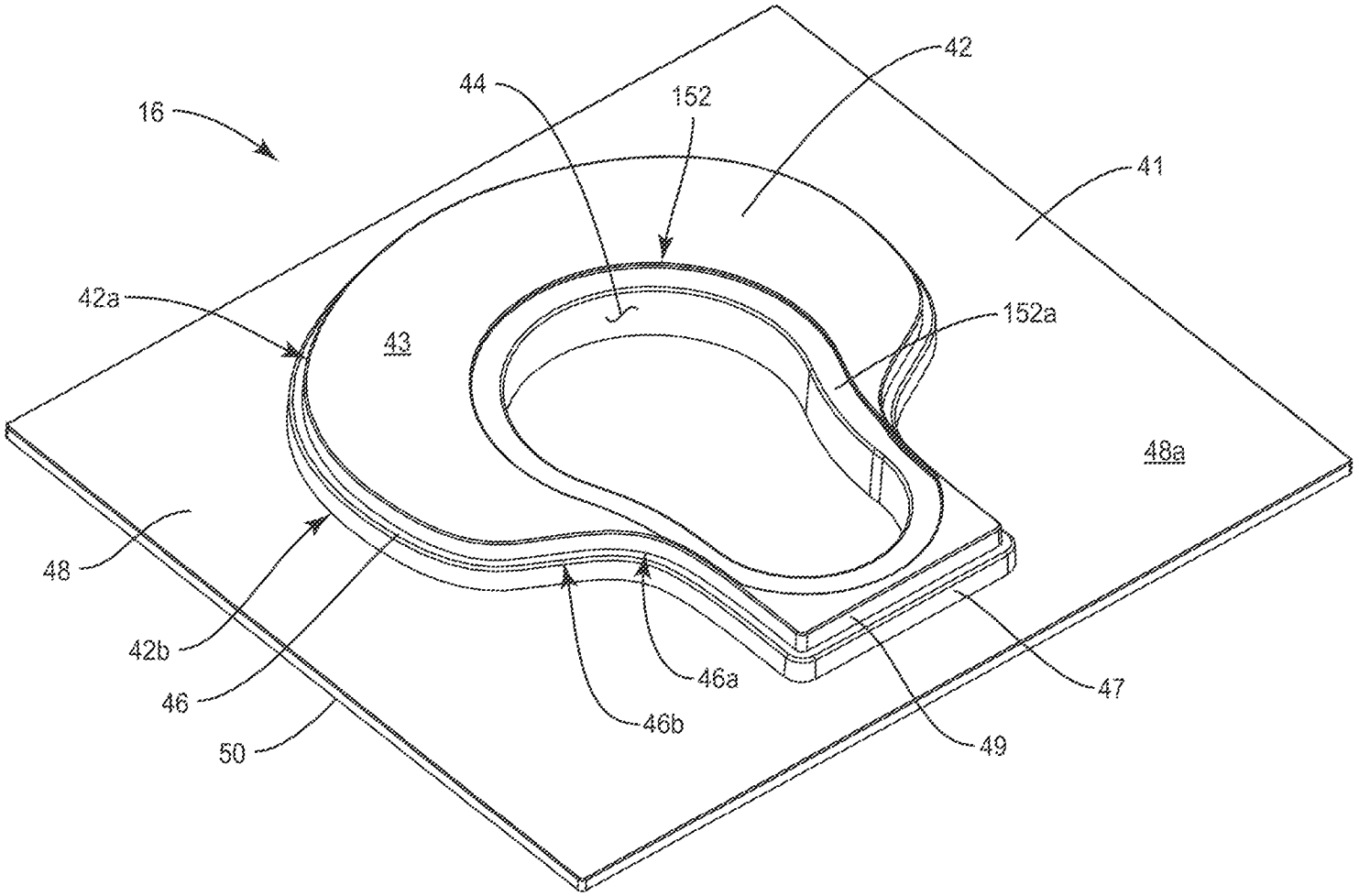
FIG. 5 provides a perspective view of a base of the modular toilet assembly of FIG. 1.

As shown in FIGS. 5 and 6, the base 16 further includes one or more base attachment portions or features 46 configured to releasably connect the base 16 to the riser(s) 14 and/or toilet seat 12. The base attachment portions 46 can include at least one projecting portion 42 formed along a top or upper surface 48*a* of the support structure 48. The projecting portion 42 can be shaped to generally correspond to the toilet seat 12 or the riser 14 such that at least a portion of the projecting portion 42 can be received by the riser 14 or toilet seat 12 for detachably connecting the toilet seat 12 or riser 14 to the base 16. The projecting portion 42 may further at least partially define a seating or squatting surface for a user to sit on or squat over when the modular toilet assembly 10 is assembled without the riser 14 or the toilet seat 12 (e.g., FIGS. 11 and 14). The projecting portion 42 may form a substantially flat surface 43 that allows a user to squat or hover over the base 16 for defecation or urination.

In one embodiment, the one or more base attachment portions 46 of the base 16 may include first 46*a* and second 46*a* attachment portions configured to connect to the toilet seat 12 and the riser 14, respectively. For example, the first engagement portion 46*a* is configured to cooperate with the lower seat attachment portion 28 of the toilet seat 12 and the second attachment feature 46*b* is configured to cooperate with lower riser engagement feature 38 of the riser 14 for connection of the toilet seat 12 or the riser 14 to the base.

FIGS. 5 and 14 generally indicate that the first attachment portion 46*a* of the base 16 includes a first, upper projecting portion 42*a* that is shaped, sized and/or configured to be at least partially received within the toilet seat opening 28*a*. The first projecting portion 42*a* includes a shoulder or one or more surfaces 49 defined therealong that are configured to engage (e.g., slidingly and/or frictionally engage) or contact at least a portion of the toilet seat body 21 substantially adjacent or proximate the toilet seat opening 28*a* to releasably secure or connect the toilet seat 12 to the base 16.

FIGS. 5 and 13 generally indicate that the second attachment portion 46*b* of the base 16 includes a second, lower projecting portion 42*b* that is shaped, sized, and/or configured to be at least partially received within the riser opening 38*a*. The second projecting portion 42*b* also includes a shoulder or one or more surfaces 47 defined therealong that are configured to engage (e.g., slidingly and/or frictionally engage) or contact at least a portion of the riser body 31 substantially adjacent or proximate the riser opening 38*a* to releasably secure or connect the riser 14 to the base 16. In one embodiment, the riser body 31 further can include a notch or recess therein such that portions of the riser body 31 at least partially engage or contact the shoulder 47 and the shoulder 49 of the first projecting portion 42*a*. The first projection portion 42*a* is formed on top of (e.g., along an upper surface of) the second projection portion 42*b*. As illustrated in FIGS. 2 and 12-18, in some embodiments, the second projecting portion 42*b* has a profile that generally corresponds to the shape and size of the ledge 32 of the riser 14.

Furthermore, FIG. 13 shows that a portion 31*b* of the riser body 31 can extend at least partially into the opening 44 in the base 16, e.g., in sliding and/or frictional engagement with the base 16 to help to provide a releasable/detachable connection between the riser 14 and the base 16.

The base 16 further can be formed from plastic or other polymeric materials, such as high density plastics (e.g., HDPE, ABS, etc.), though other suitable materials, such as synthetics, composites, etc., materials (such as ceramic, cement, steel, etc.) can be used without departing from the scope of the present disclosure.

Accordingly, with embodiments of the present disclosure, the modular toilet assembly 10 can be assembled in or reconfigurable between a plurality of different configurations. For example, in one configuration, the riser 14 can be attached to the base 16 and the toilet seat 12 can be attached to the riser 14 to provide a seated toilet configuration as illustrated in FIGS. 1, 2, 6, 12, and 13. For example, the engagement feature 46*b* of the base may cooperate with the lower riser engagement feature 38 of the riser 14 to substantially secure the riser 14 to the base 16; while the toilet seat 12 may be secured to the riser 14 when the lower seat engagement feature 28 of the toilet seat 12 cooperates with the upper riser engagement feature 36 of the riser 14.

In the illustrated embodiment, when the toilet seat 12 engages the riser 14 as shown in FIGS. 1, 2, 6, 12, and 13, the lower seat attachment portion 28 of the toilet seat body 21 can slide over the upper riser attachment portion 36 of the riser 14 (e.g., for a sliding engagement, frictional engagement, snap-fit, interference fit, etc.) so that at least a portion of the top portion 30 of the riser 14 is at least partially received in the seat attachment opening 28*a* of the toilet seat body 21. As shown in FIG. 13, an inner shoulder 91 of the toilet seat body 21 at its bottom end 20 can engage the surface 39 of the shoulder 35 of the riser 14 and a bottom edge 92 of the toilet seat body 21 (e.g., an edge of the bottom end 20 extending along the seat attachment opening 28*a*) can engage the surface 37 of the shoulder 35 of the riser 14. Further, as shown in FIG. 13, the inner shoulder 91 can extend along portions of the seat ribs 21*a* and can rest on or otherwise engage a portion of the top end 30 of the riser 14 adjacent the shoulder 35 for at least partially supporting the toilet seat 12 on the riser 14. In some embodiments, other portions of the toilet seat 12 can engage the riser 14 for supporting the toilet seat 12 on the riser 14.

As shown in FIG. 13, the lower riser engagement feature 38 of the riser 14 can slide over the attachment portion 46*b* of the base 16 (e.g., for a sliding engagement, frictional engagement, snap-fit, interference fit, etc.) so that at least a portion of the projecting portion 42 of the base 16 is at least partially received in the riser opening 38*a* of the riser body 31. In the illustrated embodiment, an inner shoulder 93 of the riser body 31 at its bottom end 40 can engage the shoulders 47, 49 of the attachment portions 46*a*, 46*b* of the base 16 and a bottom edge 94 of the riser body 31 (e.g., an edge of the bottom end 40 extending along the riser opening 38*a*) can engage the surface 48*a* of the support structure 48 of the base 16. As shown in FIG. 13, the inner shoulder 93 can extend along portions of the riser ribs 31*a*. In some embodiments, other portions of the riser 14 can engage the base 16 for supporting the riser 14 on the base 16.

In the seated toilet configuration, with the riser 14 and toilet seat 12 supported thereby attached to the base 16, the openings 24, 34, and 44 of the toilet seat 12, the riser 14 and the base 16 substantially align to form the common opening 15. Typically, a user of the seated toilet configuration illustrated in FIGS. 1, 2, 6, 12, and 13 may sit on the toilet seat 12, and the waste may be channeled through the opening 15 into a dry pit, a hole in the ground, a septic system, etc. Typically, such a toilet assembly 10 can be installed over a chamber or collection portion that is either above or below ground, e.g., is formed of cement or plastic, though a hole in the ground can be used for composting.

In another configuration, the modular toilet assembly 10 may be configured to form a squat toilet configuration. As illustrated in FIGS. 11 and 14, the toilet seat 12 can be directly attached to the base 16 allowing a user to squat while urinating or defecating. In such a configuration, the base engagement feature 46 of the base 16 cooperates with the lower seat engagement feature 28 of the toilet seat 12 to connect the toilet seat 12 to the base 16. As shown in FIG. 14, the lower seat attachment portion 28 of the toilet seat body 21 can slide over the attachment portion 46*a* of the base 16 (e.g., for a sliding engagement, frictional engagement, snap-fit, interference fit, etc.) so that at least a portion of the upper projecting portion 42*a* of the base 16 is at least partially received in the seat attachment opening 28*a* of the toilet seat body 21. In the illustrated embodiment, the inner shoulder 91 and the bottom edge 92 of the toilet seat body can engage the shoulder 49 of the attachment portion 46*a* of the base 16. As shown in FIG. 14, the inner shoulder 91 also can engage the surface 43 of the projecting portion 42 to further support the toilet seat 12 on the base 16. In some embodiments, other portions of the toilet seat 12 can engage the base 16 for supporting the toilet seat 12 on the base 16.

In the squat toilet configuration, with the toilet seat 12 attached to the base 16, the respective openings 24 and 44 of the toilet seat 12 and the base 16 align to form common opening 15 that can receive human waste from a user that squats or hovers over the opening 15. In an embodiment, a user of such a squat toilet configuration may hover over the common opening 15 at a distance of about 2 to about 10 inches. The human waste received through the common opening 15 may be channeled into a dry pit, a hole in the ground, a septic system, etc.

In yet another configuration, the modular toilet assembly 10 may include the riser 14 directly attached to the base 16 to form a seated or squat toilet configuration. In this configuration, a user may sit on or squat directly over the top end 30 of the riser 14 to urinate or defecate, without attaching the toilet seat 12 thereto. The base 16 may receive the riser 14 thereon to form the seated or squat toilet configuration with the base engagement feature 46 of the base cooperating with the lower riser engagement feature 38 of the riser 14 to connect the riser 14 to the base 16. The openings 34 and 44 of the riser 14 and the base 16 form the common opening 15 that can receive human waste, e.g., when users sit on or squat over the riser 14, which can be directed/channeled to a dry pit, hole in the ground, receptacle/sewage system, etc.

In another configuration of the modular toilet assembly 10, users may be able to use the base 16 to directly squat or hover on the projecting portion 42 thereof to urinate or defecate, without attaching the riser 14 or the toilet seat 12 thereto. Such a configuration may be suitable for users who want to use the modular toilet assembly 10 in a customary or traditional manner before gradually transitioning into the modular toilet assembly 10 with the riser 14 and/or the toilet seat 12 attached to the base 16.

In addition, the modular toilet assembly 10 further includes a plurality of removable, interchangeable inserts 50 that facilitate various operations or functions of the modular toilet assembly 10. For example, the inserts 50 can be interchangeable to allow for reconfiguration of the modular toilet assembly 10 for performance of different operations, such as separating urine and fecal matter, acting as a pour flush toilet, enabling connection to local septic or sewerage, etc. The interchangeable inserts 50 can be selected for adaptability of the modular toilet assembly 10, e.g., depending on the water availability in the region, type or lack of septic systems, type of sewerage collection system, etc. The interchangeable inserts 50 further may be used in conjunction with any of the various combinations or configurations of the modular toilet assembly 10 described with reference to FIGS. 1, 2, 6, and 11-14.

Figure 7B:
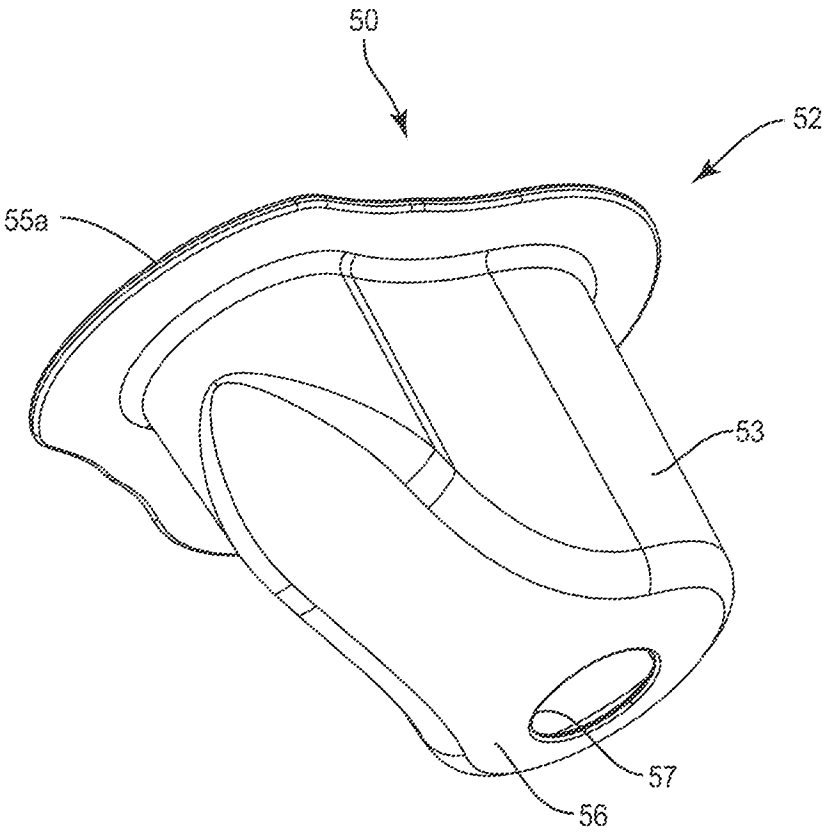
FIGS. 7A and 7B show perspective views of a septic/sewage connection insert according to principles of the present disclosure.
Figure 7A:
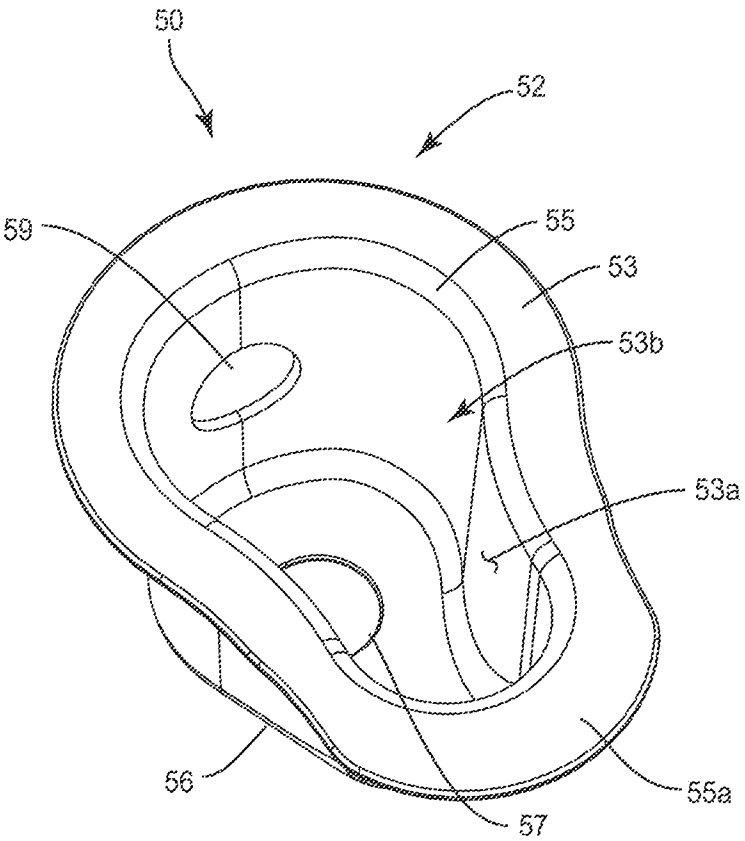

As indicated in FIGS. 7A and 7B, the plurality of inserts 50 includes a septic/sewage connection insert 52. The septic/sewage connection insert 52 is configured to be used in conjunction with the modular toilet assembly 10 to facilitate connection of the modular toilet assembly 10 to a septic or sewerage system that directs or diverts human waste received/captured by the modular toilet assembly 10. The septic/sewage connection insert 52 includes an insert body 53 that is sized, dimensioned, and/or configured to be at least partially received within the contoured openings 24, 34, 44 of the toilet seat 12, riser(s) 14, and/or base 16. The insert body 53 further includes top, upper 55 and bottom/lower portions 56. The insert body 53 also includes a waste collection cavity or chamber 53*a* defined therein and configured to receive and capture/collect human waste from users of the modular toilet assembly 10. The insert body 53 further has an opening 53*b* in communication with the waste collection chamber 53*a* that allows for the receipt of human waste therethrough and into the chamber 53*a*. The insert body 53 further includes a back or rear hole 59 (also referred to as a flush connection opening or inlet) defined therethrough that is configured to connect to a flush tank or other flushing mechanism, and a bottom or lower opening 57 (also referred to as a flush outlet) along the bottom portion 56 of the insert body 53 that is configured to be connected to a septic or sewage pipeline. Accordingly, the flush tank can be activated to evacuate or flush human waste collected within the chamber 53*a* through and out of the flush outlet 57 to the septic or sewage pipeline. More specifically, the flush tank can be activated to allow water or other liquid into the chamber 52*a* through the flush inlet 59 to flush out collected waste therein out through the flush outlet 57. As shown in FIGS. 7A and 7B, the top portion 55 further includes a lip or flange 55*a* that facilitates connection of the insert 52 to the toilet seat 12, riser 14, and/or base 16. The lip 55*a* helps to substantially secure the insert 52 between respective components when the modular toilet assembly 10 is assembled. For example, as shown in FIGS. 13 and 14, the lip 55*a* is configured to be received between the toilet seat 12 and the base 16 (or the riser 14) in a sandwich-like configuration to secure the insert 52 within the toilet assembly 10.

In one embodiment, the septic/sewage connection insert 52 can formed from plastic or other polymeric materials, such as high density plastics (e.g., HDPE, ABS, etc.), though other suitable materials, such as synthetics, composites, etc., materials (such as ceramic, cement, steel, etc.) can be used without departing from the scope of the present disclosure.

In embodiments, septic/sewage connection insert 52 can be disposed between the toilet seat 12 and the riser 14 (e.g., FIG. 13). In this case, the flush connection opening 59 is substantially aligned with the flush connection opening 51 of the riser 14, so that a connection to a flush system can be established with the insert 52 installed within the riser 14 (e.g., via a hose, pipe, or other suitable feature, not shown). In this regard, the septic/sewage connection insert 52 installed in a modular toilet assembly 12 to convert the assembly from a dry toilet to a flush toilet. Waste channeled through the opening 57 further can be diverted to septic system or other waste collection systems, such as a vacuum system, and so on. The user may operate a flush manually or automatically to dispense water through the flush opening 59 to clear the toilet assembly 10 of the waste via the opening 57.

Figure 10C:
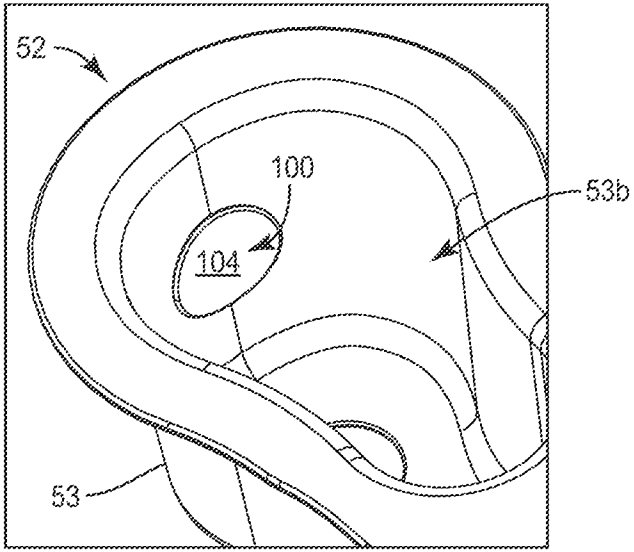
FIGS. 10B and 10C are perspective views of the cap or cover of FIG. 10A engaged with a hole of the septic/sewer insert of FIGS. 7A and 8A.
Figure 10A:
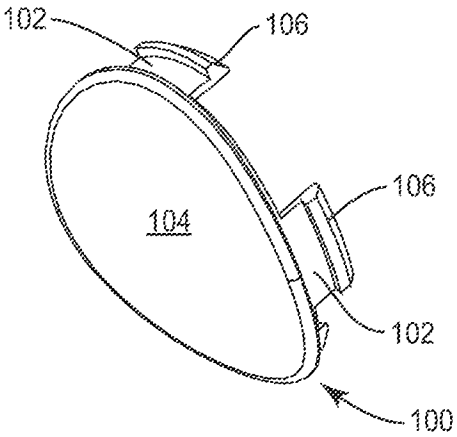
FIG. 10A shows a perspective view of a cap or cover for an insert hole according to principles of the present disclosure.
Figure 10B:
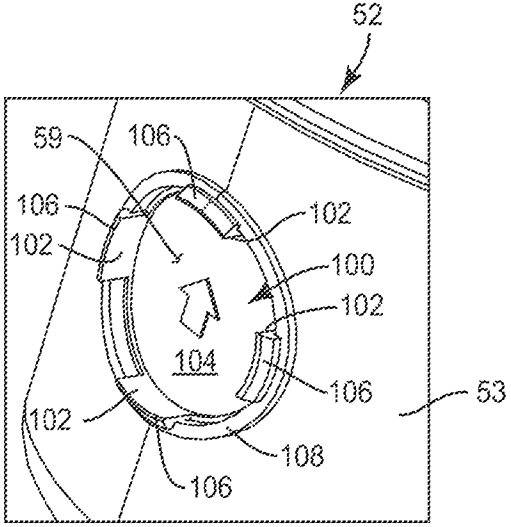

As shown in FIGS. 10A-10C, the modular toilet assembly 10 further can include one or more caps or covers 100 with retention portions or tabs 102 that are configured to be snap fitted within the opening 59 in the event a flush tank is not used, e.g., to prevent waste from entering the opening 59 (FIGS. 10A-10C). In the illustrated embodiment, the retention portions 102 can be in the form of barbed extensions that extend from a plate portion 104 of the cap 100. As shown in FIG. 10B, the retention portions 102 can be inserted through the opening 59 from the interior of the insert 52 so that the barbs 106 at the ends of the retention portions 102 engage a rim 108 extending along the opening 59 when the plate portion 104 is in contact with the interior surface of the insert 52 (FIG. 10C). Alternatively, or in addition, the retention portions 102 can engage an outer surface of the insert adjacent the opening 59 (e.g., the rim 108 could be omitted). Accordingly, the plate portion 104 can close the opening 59 along the interior of the insert 52 while the retention portions 52 retain the cap 100 in the opening 59. In some embodiments, a cap or cover, which can be similar or identical to the cap 100, can close at least a portion of the flush connection opening 51 in the riser 14 when the opening 51 is not in use. The connection of a septic or sewage pipeline further may be optional, and the septic/sewer connection 53 insert may be used with a hole in the floor, such as for composting, or other suitable waste collection, bin, container, etc., without departing from the scope of the present disclosure.

Figure 8:
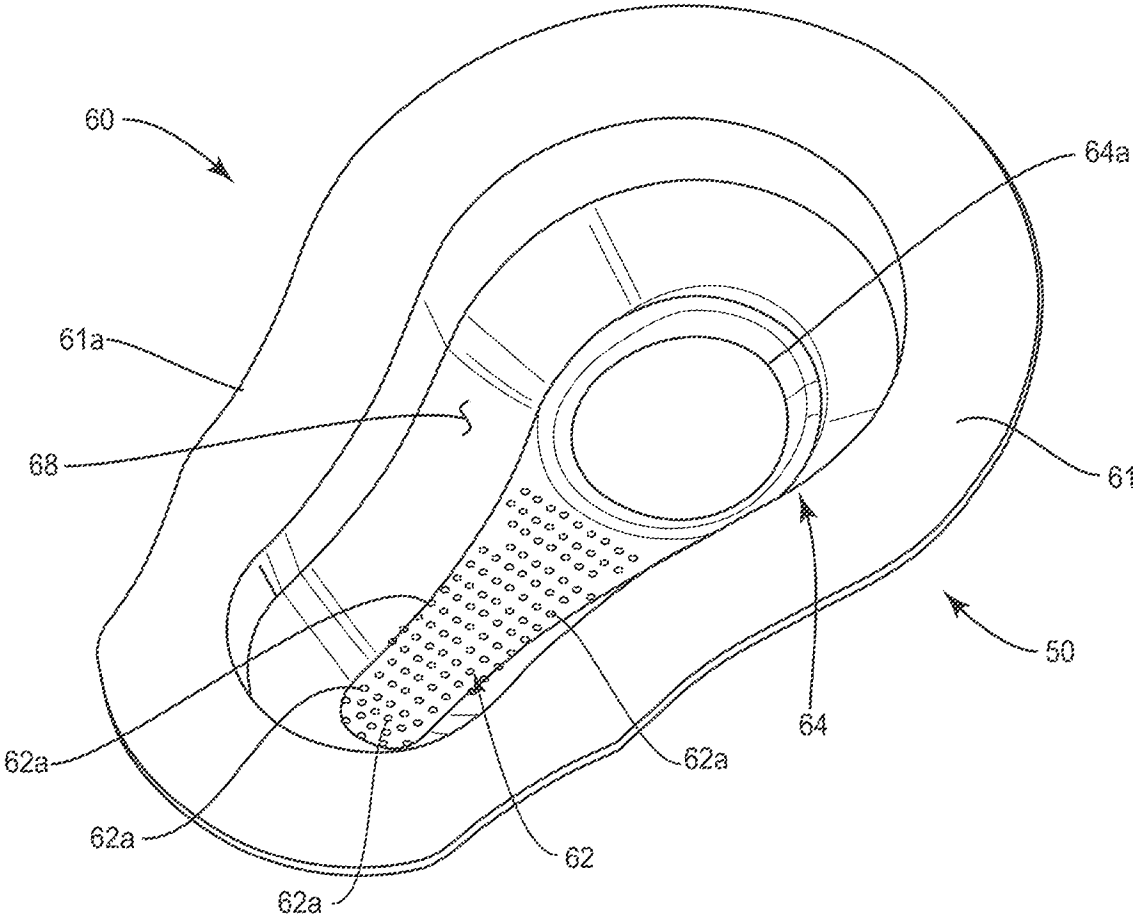
FIG. 8 provides a perspective view of a waste separating insert according to principles of the present disclosure.

FIG. 8 further shows that the plurality of inserts 50 includes a waste separating insert 60 that may be used in conjunction with the modular toilet assembly 10 to convert/reconfigure the assembly 10 into a waste separating toilet system. As shown in FIG. 8, the waste separating insert 60 can include a waste separating insert body 61 that is configured to be received within the contoured openings 24, 34, 44 of the toilet seat 12, riser(s) 14, or base 16. The insert body 61 generally includes a first portion or area 62 (also referred to as a urine collection area) with a plurality of holes or openings 62*a* that are sized to allow for the passage of urine or other liquids, but substantially block, prevent, inhibit, or reduce the passage of feces or solid waste or other solid materials. The insert body 61 further can include a second portion or area 64 (also referred to as a feces collection area) substantially adjacent the first area 62 with a hole or aperture 64*a* that is sized to allow for the receipt/passage of feces or other suitable solid waste therethrough. The insert body 61 further includes a waste collection cavity or chamber 68 that can capture/receive human waste from users who use the modular toilet assembly 10.

Accordingly, human waste, e.g., urine and/or feces can be received within the waste collection chamber 68 and sorted or separated by the urine or feces collection areas 62 or 64. Respective chambers or buckets further can be placed into alignment with the respective areas 62 and 64 (e.g., multiple chambers or buckets to correspond to the holes 62*a* for the passage of urine and/or the hole 64*a* for the passage of feces) so that urine and feces can be separated into the respective buckets or collection chambers. In this regard, the waste separating insert 60 can facilitate or enable users to compost their waste; separate urine or feces for reuse in other ways within their homes and communities, such as in the form of biochar, biogas; use urine as a form of irrigation, etc.

The waste separation insert 60 may be installed with the base 16, riser 14 and/or toilet seat 12 depending on the plumbing arrangement and may be used in any of the sit or squat configurations of the modular toilet assembly 10. The insert body 61 further can include a lip or flange 61*a* that facilitates connection of the insert 60. That is, the lip 61*a* can be engaged between two components of the modular toilet assembly 10 (i.e., toilet seat 12, riser 14, or base 16) in a sandwich-type arrangement to secure the insert 60 within openings 24, 34, 44. The lip 61*a* can be engaged between the toilet seat 12 and the riser 14.

In one embodiment, the waste separation insert 60 can formed from plastic or other polymeric materials, such as high density plastics (e.g., HDPE, ABS, etc.), though other suitable materials, such as synthetics, composites, etc., materials (such as ceramic, cement, steel, etc.) can be used without departing from the scope of the present disclosure.

Figure 9B:
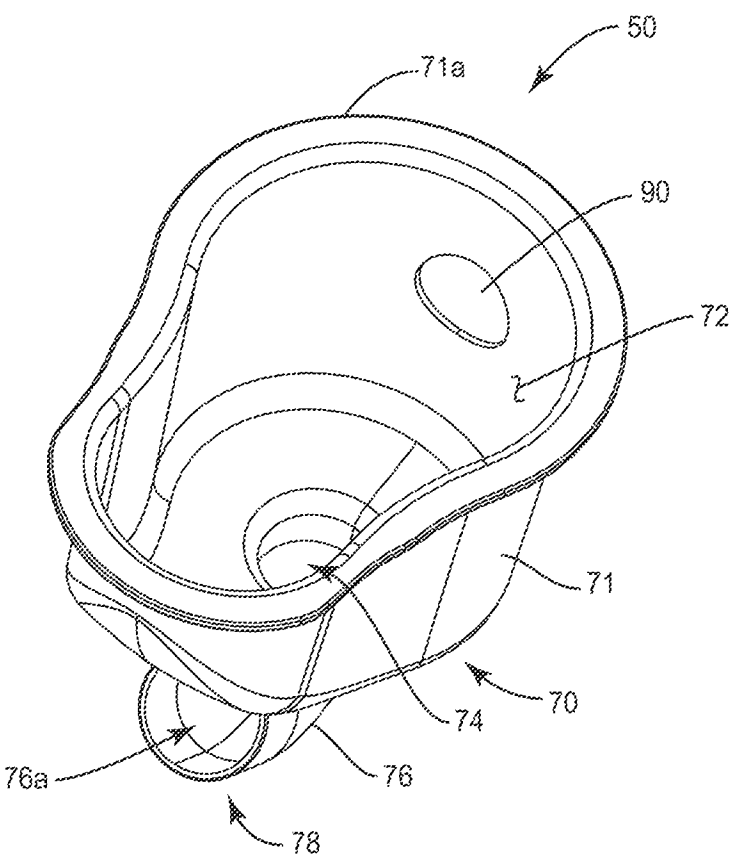
FIGS. 9A-9C provide perspective views of a pour flush insert according to principles of the present disclosure.
Figure 9A:
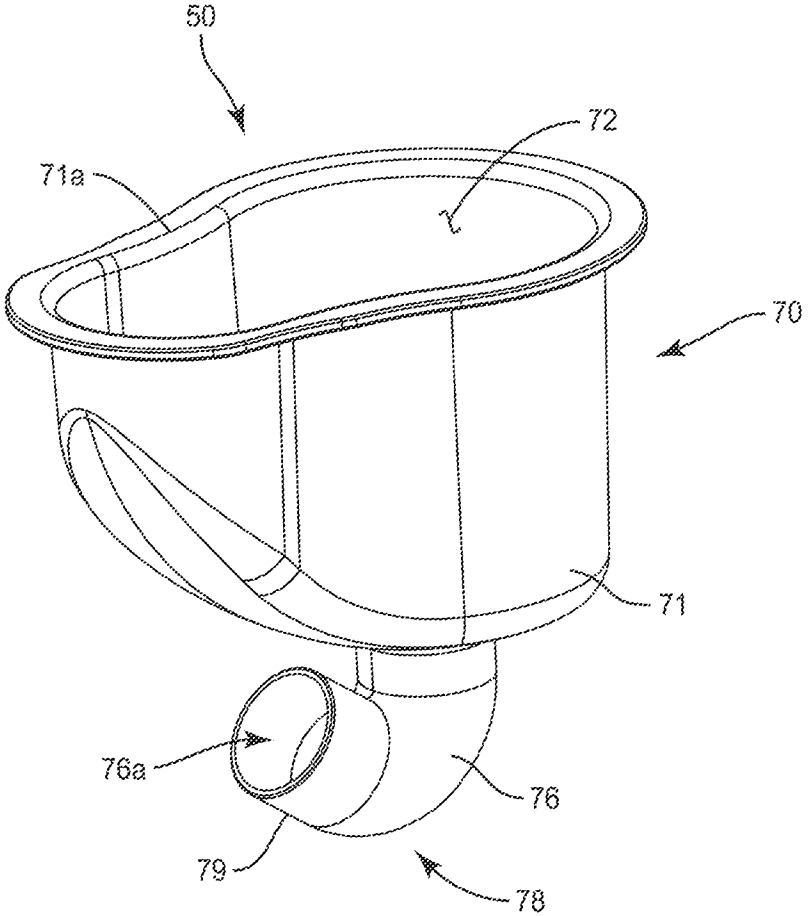
Figure 9C:
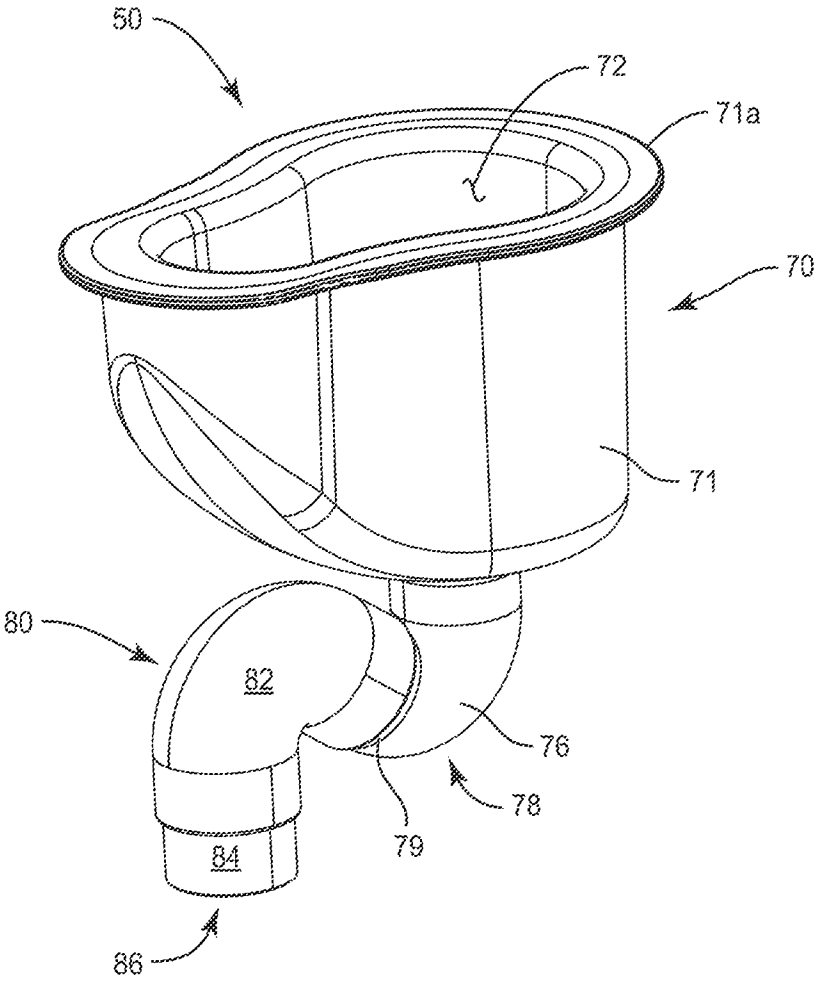

In addition, as indicated in FIGS. 9A-9C, the plurality of inserts 50 includes a pour flush insert 70 that may be used to convert/reconfigure the modular toilet assembly 10 into a pour flush toilet system. For example, the pour flush insert 70 can enable users to utilize prescribed amounts of water or other liquid, such as about 2 to 3 liters, to manually flush waste from the modular toilet assembly 10. In this regard, the pour flush insert 70 may allow users to mitigate water use in water extreme communities and/or accommodate users that are unable to afford reoccurring costs of municipal sewage/flushing systems. The pour flush insert 70 can include a pour flush insert body 71 that is configured to be received within the contoured openings 24, 34, 44 of the toilet seat 12, riser(s) 14, or base 16. The insert body 71 further can include a lip or flange 71*a* configured to facilitate a secure connection between the insert 70 and the toilet seat 12, riser 14, and/or the base 16. The insert body 71 also can include a chamber or cavity 72 defined therein for waste collection, and an opening 74 defined in a bottom portion of the chamber 72 that allows for evacuation of waste from the chamber 72. The opening 74 can be in communication with a piping or other suitable portion 76 with a passage 76*a* defined therethrough. Waste is flushed into and through the passage 76*a* when a user pours a prescribed amount of water into the chamber 72.

In the embodiments shown in FIG. 9A-9C, the piping 76 can be configured as a urine trap 78 (also referred to as a p-trap mechanism). For example, the piping 76 can include an arched or curved portion 79 extending from the bottom portion of the pour flush insert body 71. The arched or curved portion 79 can receive waste, e.g., through the opening 74, and is configured to at least temporarily retain/keep at least some liquid (e.g., water, urine, etc.) trapped within the chamber 72 and/or the passage 76*a*, e.g., to facilitate the trapping or reducing odor or smells within the modular toilet assembly 10 to make the user experience more enjoyable (such as by reducing flies, bad odor, etc.). In an alternative construction, the piping 76 can have a generally straight construction.

As shown in FIG. 9C, piping 76 further can include a piping attachment 80 that is configured to be connected to piping 76 to help to facilitate movement/removal of waste from the piping 76. The attachment 80 can include an angled or curved piping portion 82 and a substantially straight portion 84. With the piping attachment 80 connected to the piping 76, the piping 76 will have a generally serpentine shape with an opening 86 that faces downwardly, which can help to facilitate movement of liquid and solid waste through the piping 76, e.g., to prevent clogging or blockage of waste in the pipping 76. In some embodiments, the piping 76 and/or the attachment 80 can outlet waste to a collection chamber or can be connected to pipes or other suitable features for removal of waste.

FIG. 9B further shows that the pour flush insert 70 can include an opening or aperture 90 defined in the insert body 71 that facilitates connection to a flush tank or other water/liquid source, e.g., such that the pour flush insert 70 can be used therewith. The opening 90 can align with the opening 51 of the riser 14 when the pour flush insert 70 is received within the riser 14 (e.g., as shown in FIG. 13 for the alignment of the opening 59 of the insert 52 with the opening 51 of the riser). Similarly to the insert 52, a cap or cover 100 (FIGS. 10A-10C) can be secured within the opening 90 when it is not in use.

Typically, the pour flush insert 70 can be used over a waste chamber or other waste collection unit, e.g., either above or below ground, such as over a cement or plastic box that can be evacuated by a vacuum truck operation system through the pour flush insert 70, though the pour flush insert 70 also can be used over a hole in the ground. The pour flush insert 70 further may help to improve the vacuum truck operator's experience by keeping the waste wet thus enabling it to be collected with ease, in contrast to dry toilets in which waste is compacted and hard to remove from pits, latrines, or regular pit latrine toilets where trash such as diapers, clogs, or waste vacuum operations. Furthermore, the opening 74 can have a reduced area, size, dimensions, etc., e.g., to help to mitigate the amount of solid waste, such as diapers, trash, etc., that may be placed into the modular toilet assembly 10.

In one embodiment, the pour flush insert 70 can formed from plastic or other polymeric materials, such as high density plastics (e.g., HDPE, ABS, etc.), though other suitable materials, such as synthetics, composites, etc., materials (such as ceramic, cement, steel, etc.) can be used without departing from the scope of the present disclosure.

FIGS. 4 and 5 further show that the riser 14 and the base 16 each include a respective riser recessed portion 150 and base recessed portion 152 defined along or adjacent the openings 34 and 44 of the riser 14 and the base 16, respectively. These recessed portions 150/152 are sized, dimensioned, and/or otherwise configured to receive and engage at least a portion of the lips 55*a*, 61*a*, and 71*a* of the various inserts 52, 60, and 70 to facilitate a substantially secure connection of the inserts 52, 60, and 70 within the openings 34 and 44 of the riser 14 or the base 16. The recessed portions 150/152 further are shaped to be generally complementary or conform to the lips 55*a*, 61*a*, 71*a*, such that at least a portion or surface of the lips 55*a*, 61*a*, 71*a* can engage a surface 150*a*/152*a* of the recessed portions 150/152 in face to face contact or other suitable engagement. In an exemplary embodiment, the lip 55*a* of the septic/sewer connection insert 52 can engage the surface 150*a* of the recessed portion 150 of the riser 14 as shown in FIG. 13. Accordingly, the septic/sewer connection insert 52 can be at least partially supported in the opening 34 by the engagement between the lip 55*a* and the surface 150*a*. In the illustrated embodiment, bottom edges 95 of the toilet seat body 21 extending along the opening 24 of the toilet seat 12 and along the portions of the seat ribs 21*a* extending from the opening 24 can engage the upper surface of the lip 55*a*. Accordingly, the toilet seat 12 can be at least partially supported on the septic/sewer connection insert 52 at the edges 95. In one embodiment, the edges 95 can be offset from the portions of the ribs 21*a* extending along the shoulder 91 to accommodate the thickness of the lip 55*a* (e.g., the lip 55*a* can be thicker than the depth of the recessed portion 150). As shown in FIG. 14, the lip 55*a* of the septic/sewer connection insert 52 can engage the surface 152*a* of the recessed portion 152 of the base 16 so that the septic/sewer connection insert 52 is at least partially supported in the opening 44 of the base by the surface 152*a*. The separating insert 60 and the pour flush insert 70 can be supported on the riser 14 and the base 16 by the engagement between the respective lips 61*a*, 71*a* with the respective recessed portions 150, 152 in a similar manner as the septic/sewer connection insert 52. The inserts 50 could be otherwise supported on the riser 14 and the base 16 without departing from the disclosure.

In some embodiments, the modular toilet assembly 10 may be used in a dry toilet configuration. Such a dry toilet configuration may be used when there is a shortage of water for use in a pour-flush or flush type toilet, or where there is a drought, and so on. For example, the dry toilet can be configured as a sit type dry toilet or a squat type dry toilet respectively. Some dry toilets may include one or more inserts described earlier, such as a urine diverting insert, installed thereon. A user of this type of toilet assembly may sit or squat on the modular toilet assembly 10, and the waste may be channeled through the common opening 15 into a dry pit, a hole in the ground, and so on. The waste is typically collected in a unit beneath, which is either connected to an existing fecal sludge management system or is collected via a waste treatment service team who can then treat the waste at a community level (via compost or solar treatment, etc.).

Figure 15:
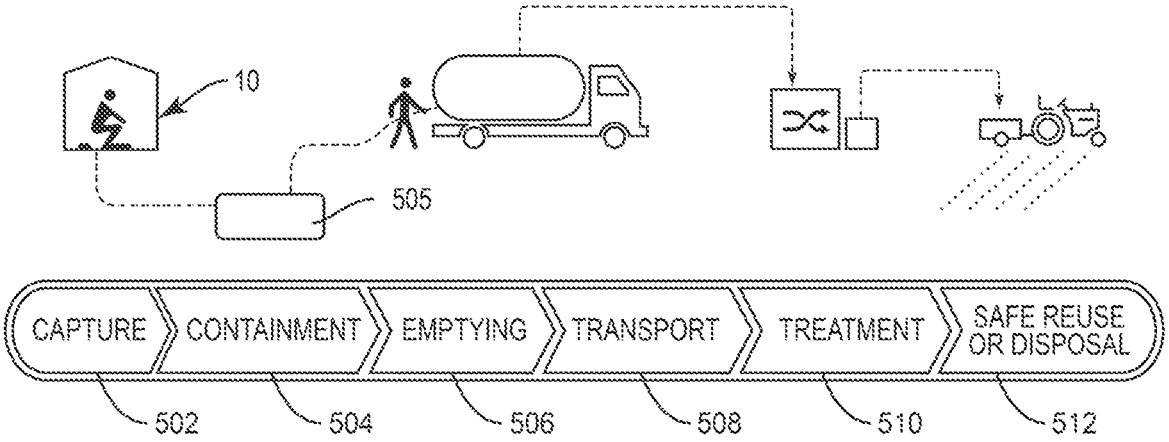
FIG. 15 shows a process flow diagram for waste collection with a modular sanitary toilet assembly according to principles of the present disclosure.

FIG. 15 shows a process flow diagram for waste management according to embodiments of the present disclosure. As shown in FIG. 19, at step 502, waste can be captured with the modular toilet assembly 10 according to embodiments of the present disclosure. As shown at 504, waste from the modular toilet assembly 10 can be diverted to a containment mechanism 505. At 506, workers, such as sanitation workers, can empty the connection mechanism 505. At 508, the waste can be transported to a treatment facility for treatment. At 510, the waste can be processed or treated for reuse or disposal. The related waste can be reused or disposed at 512.

The foregoing description generally illustrates and describes various embodiments of this disclosure. It will, however, be understood by those skilled in the art that various changes and modifications can be made to the above-discussed constructions and systems without departing from the spirit and scope of this disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of this disclosure. Accordingly, various features and characteristics as discussed herein may be selectively interchanged and applied to other illustrated and non-illustrated embodiment, and numerous variations, modifications, and additions further can be made thereto without departing from the spirit and scope of the present invention as set forth in the appended claims.

What is claimed is:

1. A toilet system, comprising:

a toilet seat that is configured for a user to sit on or squat over for depositing of human waste; and includes a toilet seat body with a toilet seat opening for receipt of the human waste and one or more seat attachment portions configured to attach the toilet seat to various components of the toilet seat system;

a riser that is configured to support and elevate the toilet seat to a selected or prescribed height, and includes a riser body with a riser opening defined therein for receipt of the human waste, a first riser attachment portion, a second riser attachment portion, and a riser recessed portion defined along the riser opening, the first riser attachment portion being connectable to the one or more seat attachment portions of the toilet seat;

a base including a base body that has a base opening for receipt of human waste, a base attachment portion that is connectable to the second riser attachment portion of the riser and/or the one or more seat attachment portions of the toilet seat, and a base recessed portion defined along the base opening; and a plurality of removable, interchangeable inserts configured to be at least partially received within the riser opening and/or the base opening, to allow for reconfiguration of the toilet system for performance of various functions or operations, each insert of the plurality of inserts comprises a flange configured for being engaged between the toilet seat and the riser and between the toilet seat and the base, the flange of each insert is configured for being at least partially received in the riser recessed portion for supporting the respective insert at least partially in the riser opening, and the flange of each insert is configured for being at least partially received in the base recessed portion for supporting the respective insert at least partially in the base opening, wherein the toilet seat is configured for selective engagement with each of the riser and the base by connecting the one or more seat attachment portions to a selected one of the first riser attachment portion and the base attachment portion.

2. The toilet system of claim 1, wherein the toilet seat body includes an upper surface that is generally curved or contoured to correspond to features of a user.

3. The toilet system of claim 1, wherein the toilet seat body includes a handle to facilitate movement of the toilet seat body.

4. The toilet system of claim 1, wherein the riser body includes a flush opening in communication with the riser opening and configured to be connected to a flush tank for flushing of waste from the toilet system.

5. The toilet system of claim 1, wherein the plurality of inserts includes a waste separation insert, a pour flush insert, and a sewage connection insert.

6. The toilet system of claim 1, wherein the plurality of inserts includes a waste separation insert including an insert body having a first area with a plurality of holes sized, dimensioned, or configured to allow for the passage of liquid waste and to substantially block the passage of solid waste, and a second area with a hole that is sized, dimensioned or configured to allow for the passage of solid waste.

7. The toilet system of claim 1, wherein the plurality of inserts includes a sewage connection insert having an insert body with one opening configured to connect to a flush tank and an additional opening configured to connect to a sewage system.

8. The toilet system of claim 1, wherein the plurality of inserts includes a pour flush insert with an insert body having a chamber for receiving the human waste and a passage in communication with the chamber that allows for waste to be evacuated from the chamber when a user pours a prescribed amount of liquid therein.

9. The toilet system of claim 8, wherein the passage includes an arched or curved portion that allows for at least temporary retention of liquid in the chamber or passage.

10. A method, comprising:

obtaining a toilet seat, a riser, and a base;

positioning the base along a ground or floor;

connecting the riser to the base by engaging a first riser attachment portion of the riser with a base attachment portion of the base;

selecting an insert of a plurality of removable, interchangeable inserts and positioning the insert at least partially within a riser opening in the riser, the inserts of the plurality of inserts being configured to allow for reconfiguration of the toilet system for performance of various functions or operations; and connecting the toilet seat to the riser by engaging a seat attachment portion of the toilet seat with a second riser attachment portion of the riser, the toilet seat is configured for selective engagement with each of the riser and the base by connecting the one or more seat attachment portions to a selected one of the second riser attachment portion and the base attachment portion.

11. The method of claim 10, further comprising removing the riser from the base and the toilet seat, positioning the insert at least partially within a base opening of the base, and engaging the one or more seat attachment portions of the toilet seat with the base attachment portion of the base.

12. The method of claim 10, wherein the insert comprises a flange and the method further comprises engaging the flange between the toilet seat and the riser to support the insert at least partially within the riser opening.

13. The method of claim 12, wherein the riser comprises a recessed portion defined along the riser opening and the engaging the flange between the toilet seat and the riser comprises positioning the flange to be at least partially received in the recessed portion.

14. The method of claim 10, wherein the plurality of inserts includes a waste separation insert, a pour flush insert, and a sewage connection insert.

* * * * *